US008365564B2

(12) United States Patent
Hirose et al.

(10) Patent No.: US 8,365,564 B2
(45) Date of Patent: Feb. 5, 2013

(54) RING ROLLING MILL AND RING ROLLING METHOD

(75) Inventors: Shimpei Hirose, Kagawa-gun (JP); Yuji Ishiwari, Okegawa (JP); Hiroaki Kikuchi, Okegawa (JP); Hideo Takizawa, Saitama (JP)

(73) Assignee: Mitsubishi Materials Corporation, Tokyo (JP)

( * ) Notice: Subject to any disclaimer, the term of this patent is extended or adjusted under 35 U.S.C. 154(b) by 798 days.

(21) Appl. No.: 12/294,533

(22) PCT Filed: Mar. 28, 2007

(86) PCT No.: PCT/JP2007/056677

§ 371 (c)(1),
(2), (4) Date: Sep. 25, 2008

(87) PCT Pub. No.: WO2007/114174

PCT Pub. Date: Oct. 11, 2007

(65) Prior Publication Data

US 2010/0236311 A1 Sep. 23, 2010

(30) Foreign Application Priority Data

Mar. 29, 2006 (JP) ..... 2006-089750

(51) Int. Cl.

| | |
|---|---|
| ***B21D 15/00*** | (2006.01) |
| ***B21D 1/02*** | (2006.01) |
| ***B21D 3/02*** | (2006.01) |
| ***B21D 19/12*** | (2006.01) |
| ***B21B 1/10*** | (2006.01) |

(52) U.S. Cl. ..... 72/110; 72/101; 72/107; 72/112; 72/87

(58) Field of Classification Search ..... 72/105–106, 72/101, 110–111, 107–108, 109, 120, 121, 72/86, 87, 112

See application file for complete search history.

(56) References Cited

U.S. PATENT DOCUMENTS

| | | | | |
|---|---|---|---|---|
| 702,303 | A * | 6/1902 | Hopkins | 72/101 |
| 1,745,514 | A * | 2/1930 | Taylor | 72/87 |
| 3,186,202 | A * | 6/1965 | Ulrych | 72/9.5 |
| 4,445,352 | A * | 5/1984 | Pols | 72/101 |

FOREIGN PATENT DOCUMENTS

| | | |
|---|---|---|
| JP | 04-210836 A | 7/1992 |
| JP | 2859446 B2 | 12/1998 |
| JP | 2003-53466 A | 2/2003 |

* cited by examiner

*Primary Examiner* — Dana Ross
*Assistant Examiner* — Mohammad I Yusuf
(74) *Attorney, Agent, or Firm* — Leason Ellis LLP

(57) ABSTRACT

This ring rolling mill includes a main roll and a mandrel provided so as to be capable of being brought close to or separated from each other, and rolling a peripheral portion of a ring-shaped body in a radial direction of the ring-shaped body while the ring-shaped body is rotated along its peripheral direction in a state where the peripheral portion of the ring-shaped body is pinched in the radial direction between an outer peripheral surface of the main roll which is rotationally driven, and an outer peripheral surface of the mandrel which is rotatable. This ring rolling mill further includes a mandrel inclining/supporting mechanism which inclines and supports the mandrel with respect to the axis of rotation of the main roll such that the gap between the outer peripheral surface of the mandrel and the outer peripheral surface of the main roll differs on one side and on the other side as seen in a direction along the axis of rotation of the main roll.

11 Claims, 15 Drawing Sheets

RING ROLLING MILL AND RING ROLLING METHOD

CROSS REFERENCE TO PRIOR RELATED APPLICATIONS

This Application is a United States national phase application under 35 U.S.C. §371 of International Patent Application No. PCT/JP2007/056677 filed Mar. 28, 2007, and claims the benefit of Japanese Patent Application No. 2006-089750 filed on Mar. 29, 2006, both of which are incorporated by reference herein. The International Application was published on Oct. 11, 2007 as International Publication No. WO 2007/114174 A1 under PCT Article 21(2).

TECHNICAL FIELD

The present invention relates to a ring rolling mill and a ring rolling method which roll a peripheral portion of a ring-shaped body in a radial direction.

BACKGROUND OF THE INVENTION

For example, a conventional ring rolling mill disclosed in Japanese Patent Publication No. 2859446, etc. rolls a peripheral portion of a ring-shaped body in a radial direction while the ring-shaped body is rotated in its peripheral direction, with the peripheral portion pinched in the radial direction between an outer peripheral surface of a main roll which is rotationally driven, and an outer peripheral surface of a mandrel which is rotatable. Also, in the conventional ring rolling mill, the peripheral portion of the ring-shaped body is rolled in the radial direction by the outer peripheral surfaces of the main roll and the mandrel by relatively bringing or separating the main roll and the mandrel close to or from each other in a state where their axes of rotation are kept substantially parallel to each other.

However, in the conventional ring rolling mill, the main roll and the mandrel are brought close to or separated from each other in a state where their axes of rotation are kept substantially parallel to each other. Thus, the pressing forces applied on the peripheral portion of the ring-shaped body by the main roll and the mandrel could be made different in every peripheral position on the peripheral portion, but could not be made different in every position in the thickness direction. That is, the pressing forces could not be made different locally in the peripheral portion of the ring-shaped body.

The invention has been made in view of the above circumstances. The object of the invention is to provide a ring rolling mill and a ring rolling method capable of making pressing forces applied on a peripheral portion of a ring-shaped body by a main roll and a mandrel made different locally in the peripheral portion of the ring-shaped body.

SUMMARY OF THE INVENTION

In order to solve the above problems, the invention has adopted the following.

A ring rolling mill including a main roll and a mandrel provided so as to be capable of being brought close to or separated from each other, and rolling a peripheral portion of a ring-shaped body in a radial direction of the ring-shaped body while the ring-shaped body is rotated along its peripheral direction in a state where the peripheral portion of the ring-shaped body is pinched in the radial direction between an outer peripheral surface of the main roll which is rotationally driven, and an outer peripheral surface of the mandrel which is rotatable, the ring rolling mill further including a mandrel inclining/supporting mechanism which inclines and supports the mandrel with respect to the axis of rotation of the main roll such that the gap between the outer peripheral surface of the mandrel and the outer peripheral surface of the main roll differs on one side and on the other side as seen in a direction along the axis of rotation of the main roll.

According to the ring rolling mill described above, the mandrel is inclinedly supported by the mandrel inclining/supporting mechanism. Thus, the pressing forces applied on the peripheral portion of the ring-shaped body by the main roll and the mandrel can be made different not only in the peripheral direction of the peripheral portion, but also in the thickness direction. As a result, the pressing forces can be made different in every portion rolled in the peripheral portion of the ring-shaped body, that is, locally. For example, while the ring-shaped body makes one rotation in the process during which the ring-shaped body is rolled while being rotated in its peripheral direction, the inclination angle of the mandrel can be made different two or more times, or the mandrel can be kept at the same inclination angle while the ring-shaped body makes one rotation.

In the ring rolling mill described above, the mandrel inclining/supporting mechanism may include a supporting frame which supports upper and lower ends of the mandrel; and a frame tilting mechanism which tilts the supporting frame.

In the ring rolling mill described above, the mandrel inclining/supporting mechanism may include a first mandrel supporting portion which rotatably supports one end of the mandrel in place; a second mandrel supporting portion which rotatably supports the other end of the mandrel; and a first mandrel driving section which brings or separates the second mandrel supporting portion close to or from the main roll.

(4) In the ring rolling mill described above, the first mandrel driving section may include an eccentric shaft fixed in place; a first connecting frame which connects the eccentric shaft and the first mandrel supporting portion; and a rotation driving portion which rotates the eccentric shaft.

(5) In the ring rolling mill described above, the first mandrel driving section may include a base portion fixed in place; a second connecting frame which connects the base portion and the first mandrel supporting portion; and a sliding driving portion which moves the second connecting frame relative to the base portion.

(6) In the ring rolling mill described above, the mandrel inclining/supporting mechanism may include a third mandrel supporting portion which rotatably supports one end of the mandrel; a fourth mandrel supporting portion which rotatably supports the other end of the mandrel; and a second mandrel driving portion which independently brings or separates both the third mandrel supporting portion and the fourth mandrel supporting portion close to or from the main roll.

A ring rolling mill including a main roll and a mandrel provided so as to be capable of being brought close to or separated from each other, and rolling a peripheral portion of a ring-shaped body in a radial direction of the ring-shaped body while the ring-shaped body is rotated along its peripheral direction in a state where the peripheral portion of the ring-shaped body is pinched in the radial direction between an outer peripheral surface of the main roll which is rotationally driven, and an outer peripheral surface of the mandrel which is rotatable, the ring rolling mill further including a main roll inclining/supporting mechanism which inclines and supports the main roll with respect to the axis of rotation of the mandrel such that the gap between the outer peripheral surface of the mandrel and the outer peripheral surface of the main roll differs on one side and on the other side as seen in a direction along the axis of rotation of the mandrel.

According to the ring rolling mill described above, the main roll is inclinedly supported by the main roll inclining/supporting mechanism. Thus, the pressing forces applied on the peripheral portion of the ring-shaped body by the main roll and the mandrel can be made different not only in the peripheral direction of the peripheral portion, but also in the thickness direction. As a result, the pressing forces can be made different in every portion rolled in the peripheral portion of the ring-shaped body, that is, locally. For example, while the ring-shaped body makes one rotation in the process during which the ring-shaped body is rolled while being rotated in its peripheral direction, the inclination angle of the main roll can be made different two or more times, or the main roll can be kept at the same inclination angle while the ring-shaped body makes one rotation.

In the ring rolling mill described above, the main roll inclining/supporting mechanism may include a first main roll supporting portion which rotatably supports one end of the main roll in place; a second main roll supporting portion which rotatably supports the other end of the main roll; and a first main roll driving section which brings or separates the second main roll supporting portion close to or from the mandrel.

In the ring rolling mill described above, the main roll inclining/supporting mechanism may include a first main roll supporting portion which rotatably supports one end of the main roll in place; a second main roll supporting portion which rotatably supports the other end of the main roll; and a second main roll driving portion which independently brings or separates both the first main roll supporting portion and the second main roll supporting portion close to or from the mandrel.

A ring rolling method of rolling a peripheral portion of a ring-shaped body in its radial direction while the ring-shaped body is rotated along its peripheral direction in a state where the peripheral portion of the ring-shaped body is pinched between a main roll and a mandrel provided so as to be capable of being brought close to or separated from each other, the ring rolling method including inclining and supporting the mandrel with respect to the axis of rotation of the main roll such that the gap between an outer peripheral surface of the mandrel and an outer peripheral surface of the main roll differs on one side and on the other side as seen in a direction along the axis of rotation of the main roll.

According to the ring rolling mill described above, the mandrel is inclined and supported. Thus, the pressing forces applied on the peripheral portion of the ring-shaped body by the main roll and the mandrel can be made different not only in the peripheral direction of the peripheral portion, but also in the thickness direction. As a result, the pressing forces can be made different in every portion rolled in the peripheral portion of the ring-shaped body, that is, locally. For example, while the ring-shaped body makes one rotation in the process during which the ring-shaped body is rolled while being rotated in its peripheral direction, the inclination angle of the mandrel can be made different two or more times, or the mandrel can be kept at the same inclination angle while the ring-shaped body makes one rotation.

The ring rolling method described above may include inclining the mandrel such that the gap become smaller on the one side than on the other side, thereby rolling the peripheral portion of the ring-shaped body; and inclining the mandrel such that the gap become smaller on the other side than on the one side, thereby rolling the peripheral portion of the ring-shaped body.

In this case, when the whole area of the peripheral portion of the ring-shaped body in its thickness direction is rolled over its whole periphery, this peripheral portion is rolled over its whole periphery in twice half and half in its thickness direction. Thereby, the contact area between the peripheral portion of the ring-shaped body and the mandrel at every rolling is made small, so that the compressive stress applied on the peripheral portion of the ring-shaped body can be increased.

Accordingly, the amount of processing for rolling the peripheral portion of the ring-shaped body in the radial direction can be made large in a state where the driving force which brings the main roll and the mandrel close to each other are kept equal to that of an existing model. As a result, compactness of a ring rolling mill used for this ring rolling method can be achieved. Moreover, since such rolling can be performed while the ring-shaped body is rotated in its peripheral direction without being removed from the ring rolling mill, the efficiency of processing can also be made high.

In addition, if rolling of the peripheral portion of a ring-shaped body in every position in its thickness directional is carried out, for example, using dies, it is necessary to take out the ring-shaped body from a cavity and heat this whenever this processing position changes. Thus, there is a possibility that a significant drop in manufacture efficiency may be caused.

A ring rolling method of rolling a peripheral portion of a ring-shaped body in its radial direction while the ring-shaped body is rotated along its peripheral direction in a state where the peripheral portion of the ring-shaped body is pinched between a main roll and a mandrel provided so as to be capable of being brought close to or separated from each other, the ring rolling method including inclining and supporting the main roll with respect to the axis of rotation of the mandrel such that the gap between an outer peripheral surface of the mandrel and an outer peripheral surface of the main roll differs on one side and on the other side as seen in a direction along the axis of rotation of the main roll.

According to the ring rolling mill described above, the main roll is inclined and supported. Thus, the pressing forces applied on the peripheral portion of the ring-shaped body by the main roll and the mandrel can be made different not only in the peripheral direction of the peripheral portion, but in the thickness direction. As a result, the pressing forces can be made different in every portion rolled in the peripheral portion of the ring-shaped body, that is, locally. For example, while the ring-shaped body makes one rotation in the process during which the ring-shaped body is rolled while being rotated in its peripheral direction, the inclination angle of the main roll can be made different two or more times, or the main roll can be kept at the same inclination angle while the ring-shaped body makes one rotation.

The ring rolling method described above may include inclining the main roll such that the gap become smaller on the one side than on the other side, thereby rolling the peripheral portion of the ring-shaped body; and inclining the main roll such that the gap become smaller on the other side than on the one side, thereby rolling the peripheral portion of the ring-shaped body.

In this case, the same operational effects as those of the ring rolling method of the above can be obtained.

ADVANTAGES OF THE INVENTION

According to the present invention, the pressing forces applied on the peripheral portion of the ring-shaped body by the main roll and the mandrel can be made different locally in the peripheral portion of the ring-shaped body.

DETAILED DESCRIPTION OF THE INVENTION

Figure 1:
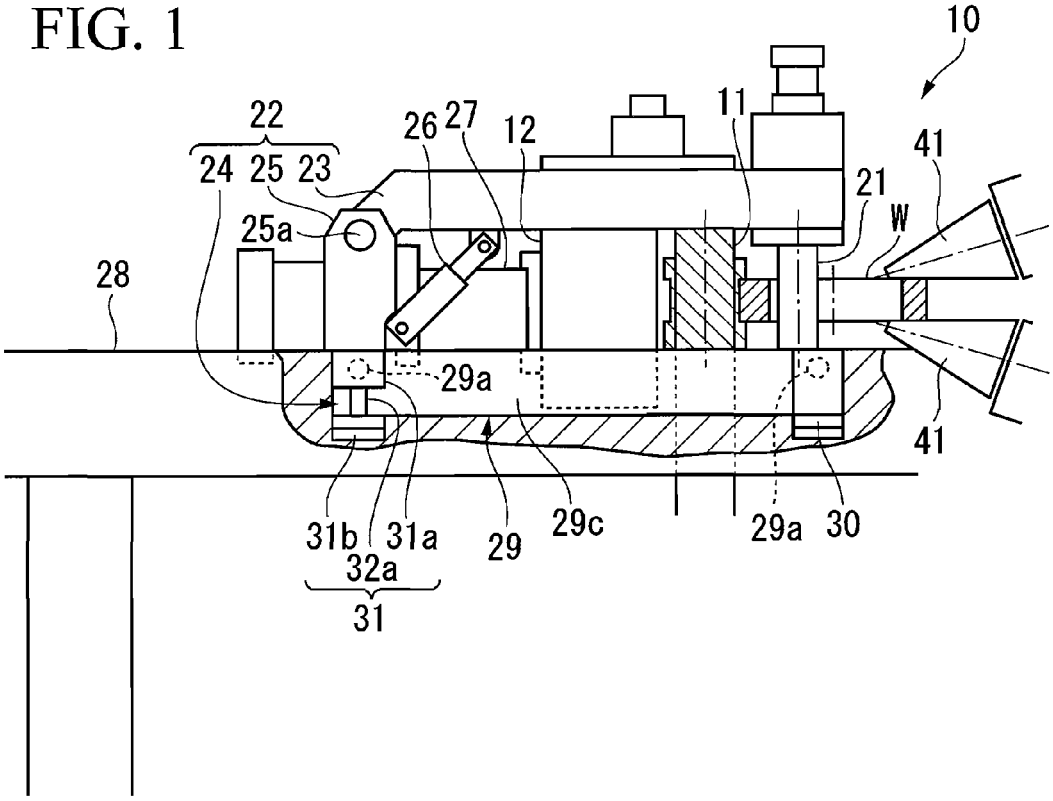
FIG. 1 is a side view showing an embodiment of a ring rolling mill of the present invention, with a portion shown in section.

Respective embodiments of a ring rolling mill and a ring rolling method of the present invention will be described below, referring to the drawings.

An embodiment of the present invention will first be described below, referring to FIG. 1 to FIG. 10C. A ring rolling mill 10 of this embodiment, as shown in FIG. 1, includes a main roll 11 and a mandrel 21 which are provided so as to be capable of being brought close to or separated from each other. With a peripheral portion of a ring-shaped body W pinched in its radial direction between an outer peripheral surface of the main roll 11 which is rotationally driven around its axis, and an outer peripheral surface of the mandrel 21 which is rotatable around its axis, the peripheral portion is rolled in the radial direction while the ring-shaped body W is rotated in its peripheral direction.

In addition, the ring-shaped body W is formed by slab-forging melted ingot, and then forming a through hole in this ingot.

In the position opposite the main roll 11 and the mandrel 21 with the axis of the ring-shaped body W therebetween, a pair of axial rolls 41 which pinches the ring-shaped body W in its thickness direction is provided so as to be capable of being rotationally driven around their axes of rotation. The axial rolls 41 are supported so as to be capable of advancing and retreating along the radial direction of the ring-shaped body W.

The main roll 11 is supported by a fixed frame 12 so as to be capable of being rotationally driven around its axis of rotation in a state where its axis of rotation runs along a vertical direction. The outer peripheral surface of the main roll 11 supports an outer peripheral surface of the ring-shaped body W.

The mandrel 21 is supported so as to be rotatable around its axis of rotation with respect to a movable frame 22 in a state where its axis of rotation is substantially parallel to the axis of rotation of the main roll 11. The outer peripheral surface of the mandrel 21 presses the inner peripheral surface of the ring-shaped body W outward in its radial direction.

The movable frame 22 includes a pair of upper frames 23 which extend horizontally toward the main roll 11 from the mandrel 21, a pair of lower frames 24 which are provided vertically below the upper frames 23 and extend substantially parallel to an extension direction of the upper frames 23, and an intermediate frame 25 which connects each upper frame 23 and each lower frame 24. The intermediate frame 25 connects the rear end of each upper frame 23 and the rear end of each lower frame 24 opposite their front ends on the side where the mandrel 21 is disposed.

Bridging frames (not shown) which connect the pair of upper frames 23 and the pair of lower frames 24, respectively, are disposed at the front end of each upper frame 23 and at the front end of each lower frame 24, respectively. Both ends of the mandrel 21 in the direction of its axis of rotation are supported by these bridging frames so as to be rotatable around the axis of the mandrel.

Each upper frame 23 is supported so as to be rotatable in the vertical direction about a pin 25*a* inserted through the intermediate frame 25. A base end of an opening/closing cylinder 26 is attached to the intermediate frame 25. A distal end of a rod of the cylinder 26 is attached to a lower surface of the upper frame 23. Thereby, when the opening/closing cylinder 26 is driven to advance and retreat, each upper frame 23 rotates in the vertical direction about the pin 25*a* along with the bridging frames and the mandrel 21 which are provided at the front ends of the upper frames 23.

The intermediate frame 25 is provided with an advance/retreat driving cylinder 27. Also, the distal end of the rod of the advance/retreat driving cylinder 27 is connected with the fixed frame 12 which supports the main roll 11. Consequently, if the advance/retreat driving cylinder 27 is driven to advance and retreat, the reaction force from the fixed frame 12 acts on the intermediate frame 25, and the whole movable frame 22 including the intermediate frame 25, the upper frame 23, the lower frame 24, and each of the bridging frame moves horizontally along with the mandrel 21.

The lower frames 24 are supported by a pair of rail portions 28, respectively, which extend substantially parallel to the extension direction of the frames 24. Each lower frame 24 includes a pair of lower frame bodies 29 which extend horizontally toward the main roll 11 from the mandrel 21, and first and second fitting projections 30 and 31 which are respectively provided at both longitudinal ends of each of outer lateral surface 29*c* opposite the inner lateral surfaces which face each other, among outer surfaces of the lower frame bodies 29. That is, the front end of both the longitudinal ends of the outer lateral surface 29*c* on the side where the mandrel 21 is disposed is provided with the first fitting projection 30, and the rear end opposite the front end is provided with the second fitting projection 31.

Figure 4:
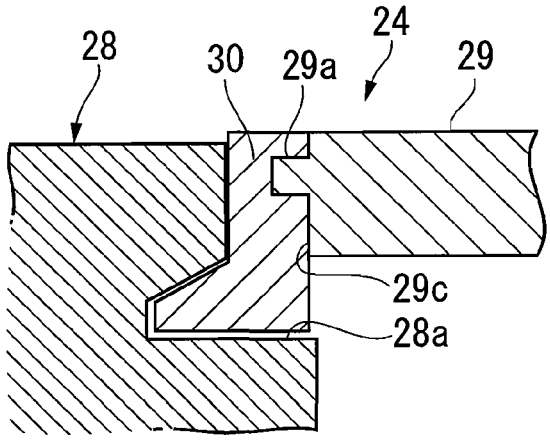
FIG. 4 is a sectional view of the lower frame body and the first fitting projection shown in FIG. 3.
Figure 5:
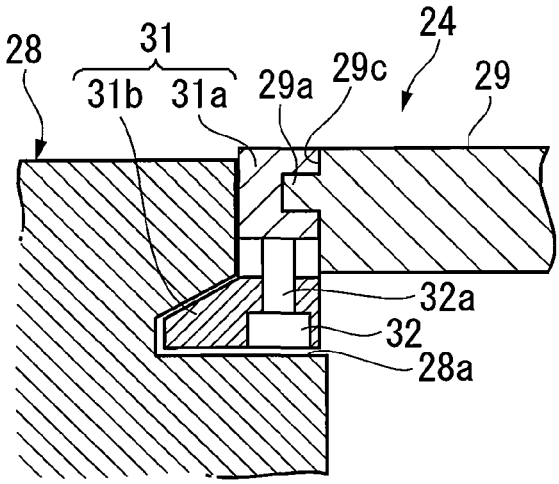
FIG. 5 is a sectional view of the lower frame body and the second fitting projection shown in FIG. 2.

As shown in FIGS. 4 and 5, as the first and second fitting projections 30 and 31 are slidably fitted into grooves 28*a*, respectively, which are formed in the inner lateral surfaces which face each other in the pair of rail portions 28, the lower frames 24 are supported by the rail portions 28.

Further, as the pins 29*a* provided so as to protrude from both the longitudinal ends on the outer lateral surface 29*c* of the lower frame body 29 are fitted into holes, respectively, which are formed in the first and second fitting projections 30 and 31, respectively, the first and second fitting projections 30 and 31 are rotatably supported about the pins 29*a*.

The first fitting projection 30 is such that a portion into which the pin 29*a* of the lower frame body 29 is fitted, and a portion which is fitted into the groove 28*a* of the rail portion 28 are formed integrally.

Figure 2:
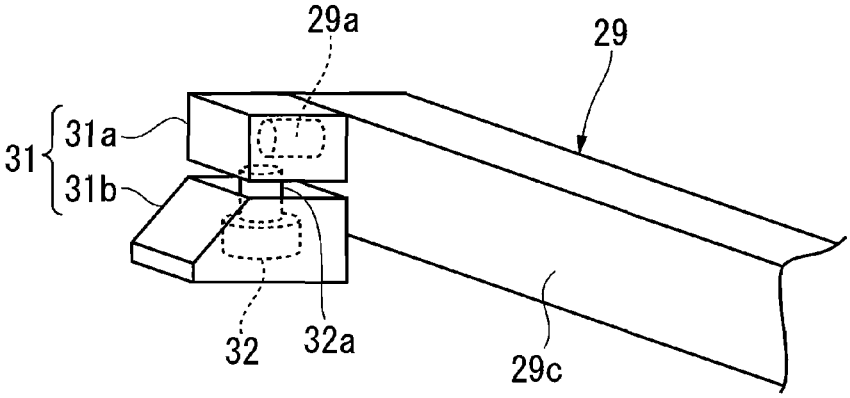
FIG. 2 is a perspective view showing a lower frame body and a second fitting projection when the axis of rotation of a main roll and the axis of rotation of a mandrel are parallel to each other in the ring rolling mill.
Figure 3:
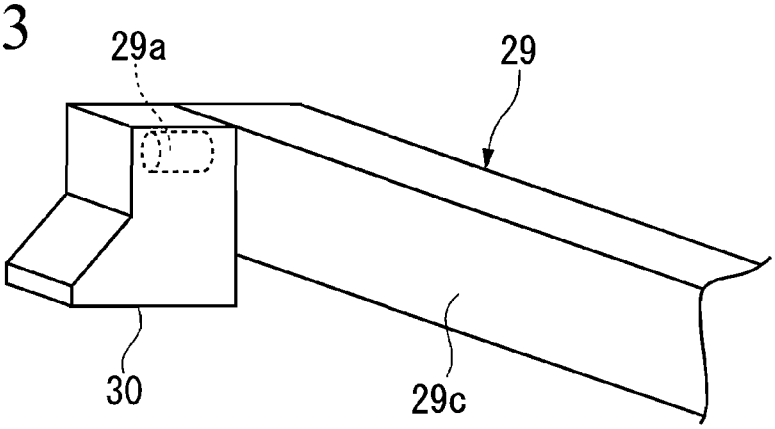
FIG. 3 is a perspective view showing the lower frame body and a first fitting projection when the axis of rotation of the main roll and the axis of rotation of the mandrel are parallel to each other in the ring rolling mill.

As shown in FIGS. 2 and 5, the second fitting projection 31 includes an upper fitting projection 31*a* which is rotatably fitted into the pin 29*a* of the lower frame body 29, and a lower fitting projection 31*b* which is arranged below the upper fitting projection 31*a*, and is slidably fitted into the groove 28*a* of the rail portion 28.

An elevating cylinder 32 which can advance and retreat in the vertical direction is provided inside the lower fitting projection 31*b*. The upper fitting projection 31*a* and the lower fitting projection 31*b* are connected together via a rod 32*a* of the cylinder 32. When the rod 32*a* of the elevating cylinder 32 is located in the intermediate position between an extended end and a retracted end, that is, when a gap is formed between a lower surface of the upper fitting projection 31*a* and an upper surface of the lower fitting projection 31*b*, the extension direction of the lower frame bodies 29 and the extension direction of the rail portion 28 become parallel to each other, and the axis of rotation of the main roll 11 and the axis of rotation of the mandrel 21 become parallel to each other.

Figure 6:
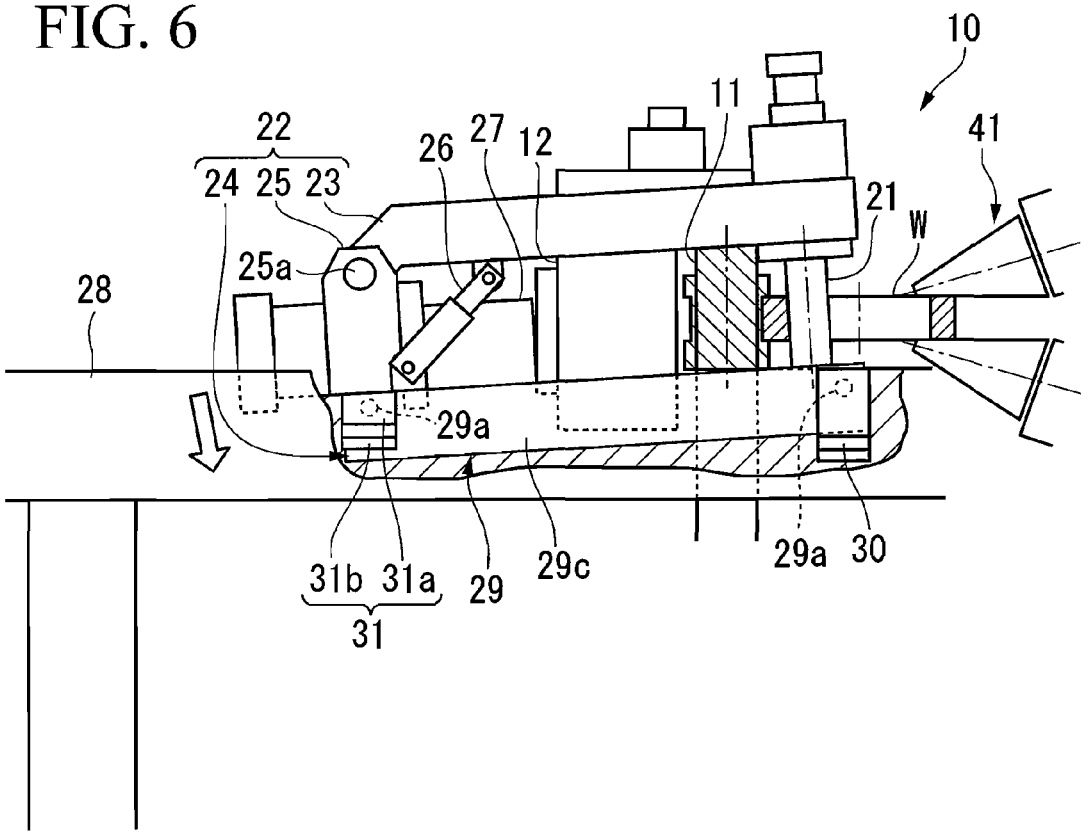
FIG. 6 is a side view when the axis of rotation of the mandrel is inclined such that a gap between a vertical upper portion of an outer peripheral surface of the mandrel, and an outer peripheral surface of the main roll becomes smaller than a gap between a vertical lower portion of the outer peripheral surface of the mandrel, and the outer peripheral surface of the main roll, in the ring rolling mill, with a portion shown in section.
Figure 7:
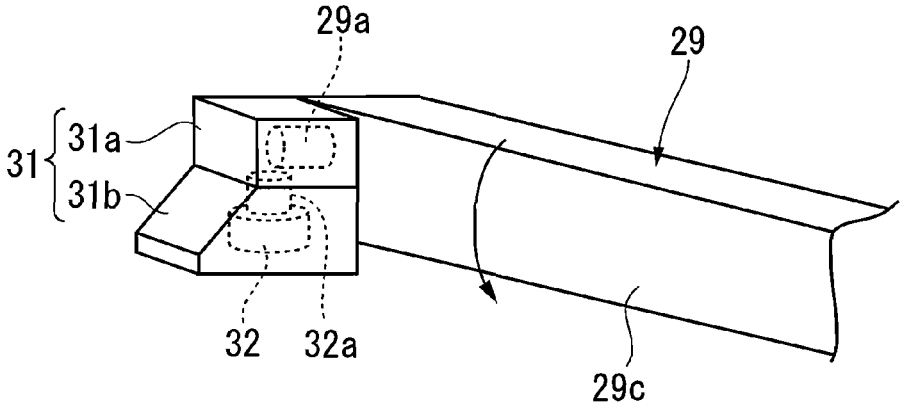
FIG. 7 is a perspective view showing the lower frame body and the second fitting projection of this ring rolling mill in the state of FIG. 6.

If the rod 32*a* of the elevating cylinder 32 is retracted from this parallel state, as shown in FIGS. 6 and 7, the lower surface of the upper fitting projection 31*a* and the upper surface of the lower fitting projection 31*b* contact each other. Then, the lower frame body 29 rotates about the pin 29*a* provided at the front end of its outer lateral surface 29*c* such that its rear end moves vertically downward. As a result, the axis of rotation of the mandrel 21 attached between the bridging frames of the movable frame 22 is inclined such that a gap between a vertical upper portion of the outer peripheral surface of the mandrel 21, and the outer peripheral surface of the main roll 11 becomes smaller than a gap between a vertical lower portion of the outer peripheral surface of the mandrel, and the outer peripheral surface of the main roll 11.

Figure 8:
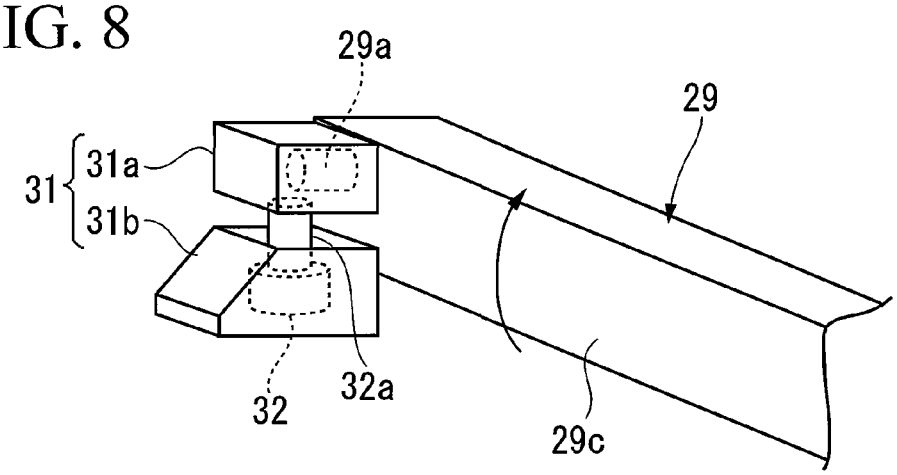
FIG. 8 is a view when the axis of rotation of the mandrel is inclined such that a gap between the vertical upper portion of the outer peripheral surface of the mandrel, and the outer peripheral surface of the main roll becomes larger than a gap between the vertical lower portion of the outer peripheral surface of the mandrel, and the outer peripheral surface of the main roll, in the ring rolling mill, and is a perspective view of the lower frame body and the second fitting projection.
Figure 9:
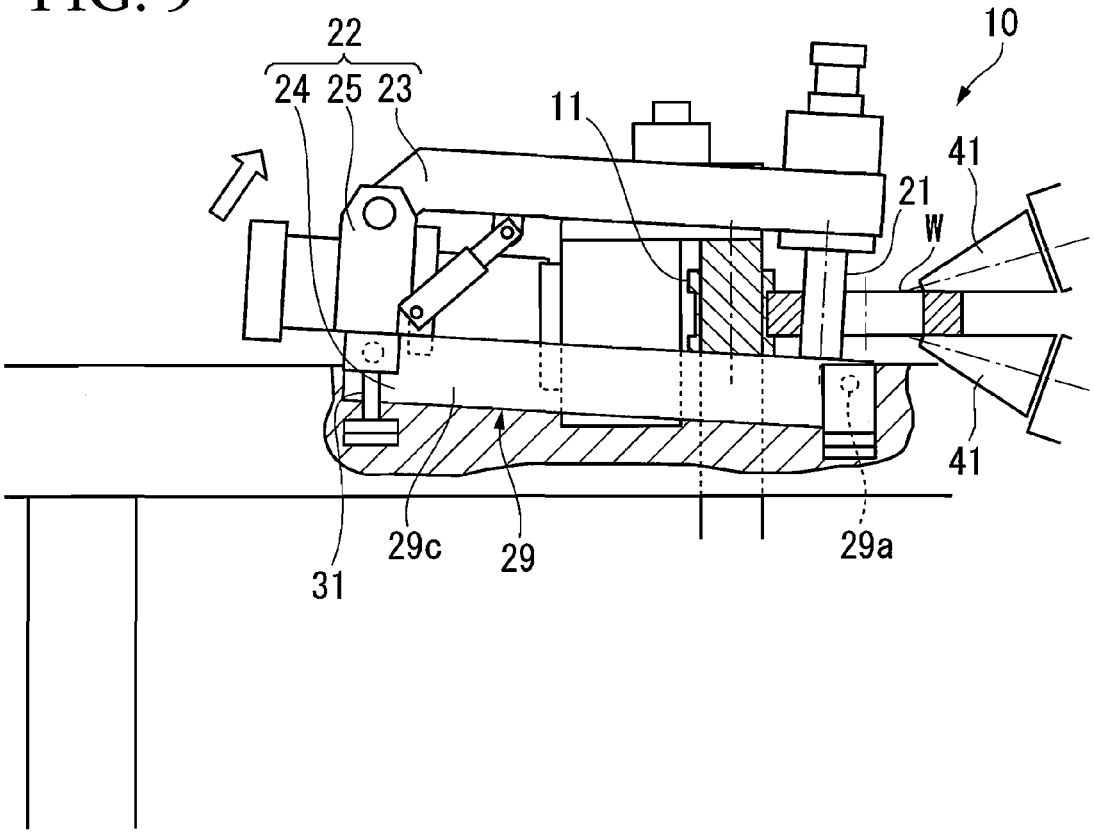
FIG. 9 is a side view in the above state of the ring rolling mill, with a portion shown in section.

On the contrary, if the rod 32*a* of each elevating cylinder 32 is extended from this parallel state, as shown in FIG. 8, the distance between the lower surface of the upper fitting projection 31*a* and the upper surface of the lower fitting projection 31*b* becomes large. Then, as shown in FIG. 9, the lower frame body 29 rotates about the pin 29*a* provided at the front end of its outer lateral surface 29*c* such that its rear end moves vertically upward. As a result, the axis of rotation of the mandrel 21 attached to the rotary frame 22 is inclined such that a gap between the vertical lower portion of the outer peripheral surface of the mandrel 21, and the outer peripheral surface of the main roll 11 becomes smaller than a gap between the vertical upper portion of the outer peripheral surface of the mandrel, and the outer peripheral surface of the main roll 11.

As mentioned above, the mandrel 21 is supported so as to be capable of being inclined with respect to the axis of rotation of the main roll 11 such that the gap dimension between the outer peripheral surface of the mandrel and the outer peripheral surface of the main roll 11 differ on one side and the other side in the direction of its axis of rotation.

A ring rolling method using the ring rolling mill 10 of this embodiment will be described below.

First, the advance/retreat driving cylinder 27 is retreated to separate the main roll 11 and the mandrel 21 from each other, and to retreat the axial rolls 41 with respect to the ring-shaped body W. In this state, after the opening/closing cylinder 26 is extended to rotate the upper frame 23 vertically upward along with the mandrel 21 about the pin 25*a* inserted through the intermediate frame 25, the ring-shaped body W is arranged. Thereafter, the opening/closing cylinder 26 is retracted to rotate the upper frame 23 vertically downward about the pin 25*a* along with the mandrel 21. Then, the outer peripheral surface of the main roll 11 and the outer peripheral surface of the ring-shaped body W are made to face each other, and the outer peripheral surface of the mandrel 21 and the inner peripheral surface of the ring-shaped body W are made to face each other.

At this time, the pair of axial rolls 41 are advanced toward the ring-shaped body W, and the ring-shaped body W is pinched in its thickness direction by the outer peripheral surface of these axial rolls 41. Also, the advance/retreat driving cylinder 27 is extended to bringing the mandrel 21 close to the main roll 11. As a result, the peripheral portion of the ring-shaped body W is pinched in its radial direction between the outer peripheral surface of the mandrel 21 and the outer peripheral surface of the main roll 11.

Next, the ring-shaped body W is rotated in its peripheral direction by rotationally driving the main roll 11 and the axial rolls 41 about each axis of rotation. Then, while the mandrel 21 rotates about its axis of rotation, the peripheral portion of the ring-shaped body W is rolled in its radial direction over its whole periphery. In this rolling process, as the thickness of the peripheral portion of the ring-shaped body W in its radial direction becomes smaller, the mandrel 21 gradually advances toward the outer peripheral surface of the main roll 11 by the pressing force to the fixed frame 12 by the advance/retreat driving cylinder 27. Moreover, in this rolling process, as the diameter of the ring-shaped body W increases, the axial rolls 41 gradually retreats radially outward of the ring-shaped body W.

In this rolling process, if necessary, each elevating cylinder 32 is extended or retracted from its parallel state. Thereby, the axis of rotation of the mandrel 21 is inclined with respect to the axis of rotation of the main roll 11 such that the gap between the outer peripheral surface of the mandrel and the outer peripheral surface of the main roll 11 differs on one side and the other side in the direction of its axis of rotation. Thereby, the pressing force applied on the ring-shaped body W can be changed along its axis direction.

Figure 10A:
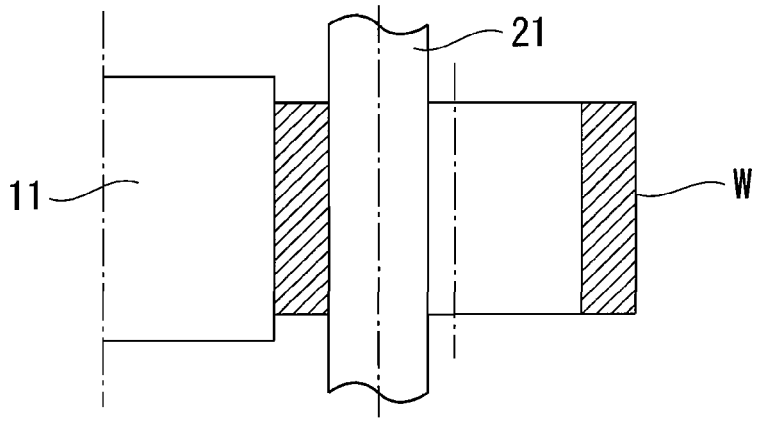
FIG. 10A is a sectional view for explaining the step of correcting a taper during rolling of the ring-shaped body.
Figure 10B:
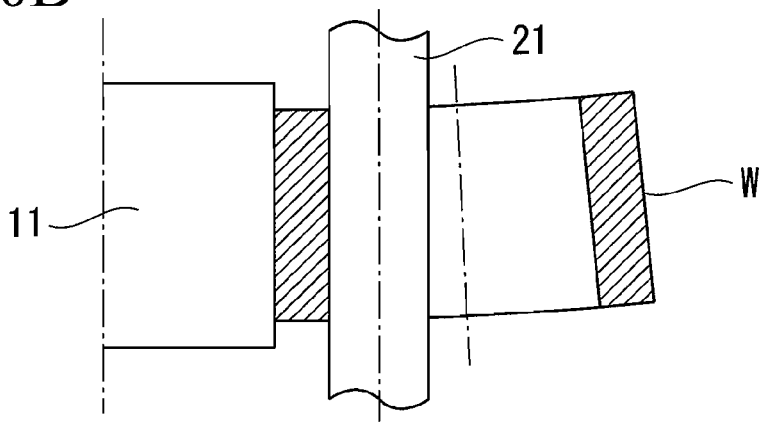
FIG. 10B is a sectional view for explaining continuation of the correcting step.
Figure 10C:
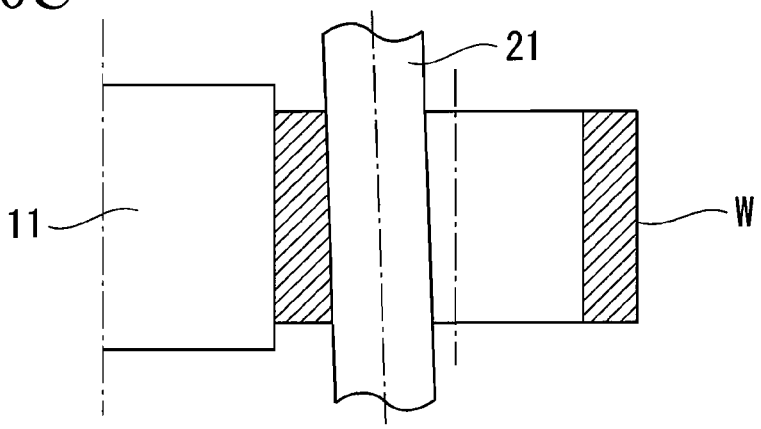
FIG. 10C is a sectional view for explaining continuation of the correcting step.

In addition, the taper of the ring-shaped body W can also be removed utilizing a rocking mechanism of the mandrel 21 in the ring rolling mill 10. This will be described with reference to FIGS. 10A to 10C. As shown in FIG. 10A, when any variation exists in the material shape of the ring-shaped body W in a case where the ring-shaped body can be normally rolled with constant thickness along its axis, the ring-shaped body W may be tapered as shown in, for example, FIG. 10B. In such a case, as shown in FIG. 10C, the taper of the ring-shaped body W can be removed by performing rolling while the mandrel 21 is inclined at a proper angle with respect to the main roll 11.

As described above, in the ring rolling mill 10 of this embodiment, a configuration in which the main roll 11 and the mandrel 21 are provided so that they can be brought close to or separated from each other, and the movable frame 22 (mandrel inclining/supporting mechanism) which inclines and supports the mandrel 21 with respect to the axis of rotation of the main roll 11 is provided such that the dimension of the gap between the outer peripheral surface of the main roll 11 and the outer peripheral surface of the mandrel 21 differs on vertical upper side (one side) and on vertical lower side (other side) as seen in a direction along the axis of rotation of the main roll 11 is adopted. Moreover, a configuration in which the movable frame 22 includes each upper frame 23 and each lower frame 24 (supporting frame) which support upper and lower ends of the mandrel 21; and the second fitting projection 31 (frame tilting mechanism) which tilts the upper frame 23 and the lower frame 24 is adopted.

According to this configuration, the pressing forces applied on the peripheral portion of the ring-shaped body W by the main roll 11 and the mandrel 21 can be made different not only along every peripheral position of the peripheral portion, but also along positions in the thickness direction. As a result, the pressing forces can be made different in every portion rolled in the peripheral portion of the ring-shaped body W, that is, locally.

For example, while the ring-shaped body W makes one rotation in the process during which the ring-shaped body W is rolled while being rotated in its peripheral direction, the inclination angle of the mandrel can be made different two or more times, or the mandrel can be kept at the same inclination angle while the ring-shaped body makes one rotation.

Further, since the mandrel 21 is inclinedly supported, when the peripheral portion of the ring-shaped body W is rolled over the whole area in its thickness direction, the mandrel 21 is inclined such that the gap between the outer peripheral surface of the mandrel and the outer peripheral surface of the main roll 11 becomes smaller on one side in the direction of its axis of rotation than on the other side in the direction of its axis of rotation. Thereby, the portion of the peripheral portion of the ring-shaped body W which faces the portion of the outer peripheral surface of the mandrel 21 on the other side in the direction of the axis of rotation can be rolled over its whole periphery by inclining the mandrel 21 such that the gap becomes smaller on the other side in the direction of its axis of rotation than on one side in the direction of its axis of rotation after the portion of the peripheral portion of the ring-shaped body W which faces the portion of the outer peripheral surface of the mandrel 21 on one side in the direction of the axis of rotation.

Accordingly, when the whole area of the peripheral portion of the ring-shaped body W in its thickness direction is rolled over its whole periphery, this peripheral portion are rolled over its whole periphery in twice half and half in its thickness direction. Thereby, the contact area between the peripheral portion of the ring-shaped body W and the mandrel 21 at every rolling is made small, so that the compressive stress applied on the peripheral portion of the ring-shaped body W can be increased. Thereby, the amount of processing which rolls the peripheral portion of the ring-shaped body W in the radial direction can be made large in a state where the driving force which brings the main roll 11 and the mandrel 21 close to each other are kept equal to that of an existing model. Consequently, both an increase in the rolling amount of the ring rolling mill 10 and the compactness thereof can be made compatible with each other. Moreover, since the ring-shaped body W can be rolled while being rotated in its peripheral direction without being removed from the ring rolling mill 10, the efficiency of processing can also be made high.

Subsequently, another embodiment of the present invention will be described below, referring to FIG. 11A to FIG. 15. In addition, in the following description, differences from those of the above embodiment will be mainly described, and the other points are the same as those of the above embodiment, and the description thereof will be omitted.

In the above embodiment, the mandrel 21 is inclined by rotating the whole movable frame 22 in the vertical direction, whereas in the ring rolling mill 110 of this embodiment, the mandrel 21 is inclined by horizontally translating a member (hereinafter, upper frame 123) equivalent to the upper frame 23. This embodiment to be described below is particularly different from the above embodiment in regard to this point.

Figure 11A:
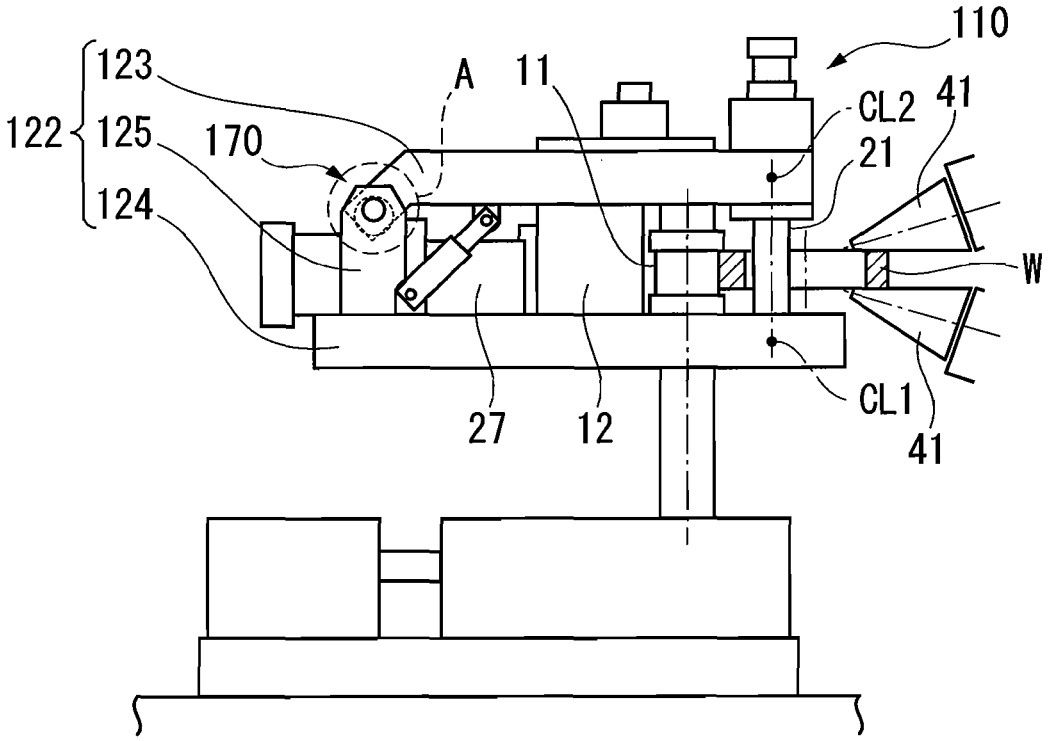
FIG. 11A is a side view showing another embodiment of the ring rolling mill of the present invention.

As shown in FIG. 11A, a ring rolling mill 110 of this embodiment includes a tilting frame 122 as the mandrel inclining/supporting mechanism of the present invention.

The tilting frame 122 includes a pair of upper frames 123 which extend horizontally toward the main roll 11 from the mandrel 21, a pair of lower frames 124 which are provided vertically below the upper frames 123 and extend substantially parallel to an extension direction of the upper frames 123, and an intermediate frame 125 which connects each upper frame 123 and each lower frame 124. The intermediate frame 125 connects the rear end of each upper frame 123 and the rear end of each lower frame 124 opposite their front ends on the side where the mandrel 21 is disposed.

Figure 12:
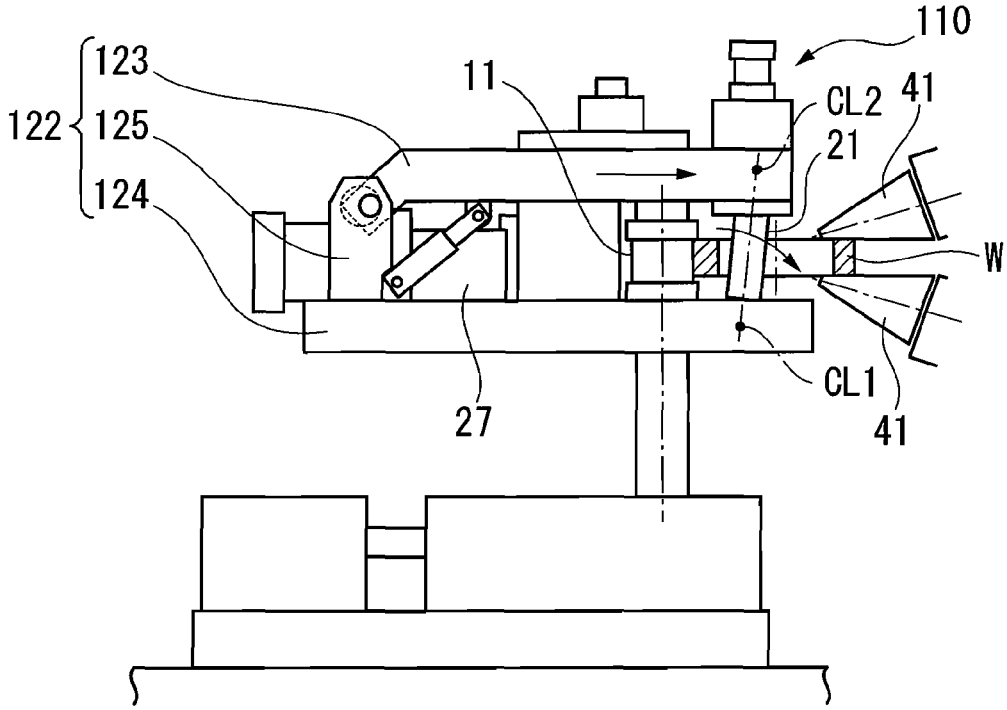
FIG. 12 is a side view for explaining the operation of the ring rolling mill.
Figure 13:
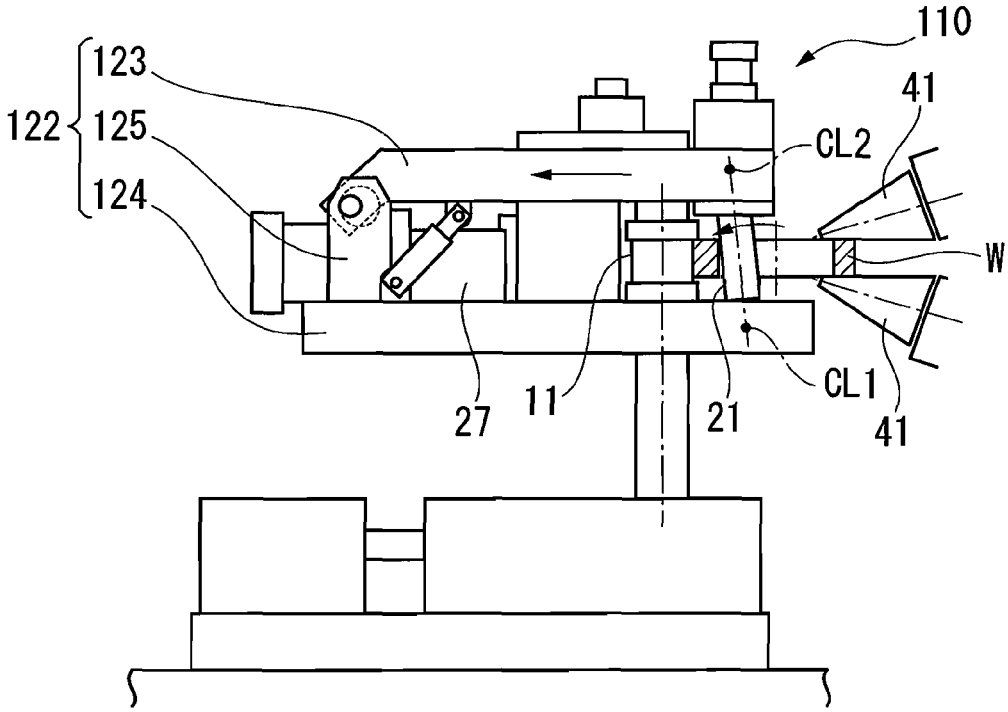
FIG. 13 is a side view for explaining the operation of the ring rolling mill.

In addition, in FIGS. 11A, 12, and 13, illustration of the rail portions 28 is omitted for the purpose of explanation. This is also the same for the following embodiments.

Bridging frames (not shown) which connect the pair of upper frames 123 and the pair of lower frames 124, respectively, are disposed at the front end of each upper frame 123 and at the front end of each lower frame 124, respectively. Both ends of the mandrel 21 in the direction of its axis of rotation are supported by these bridging frames so as to be rotatable around the vertical axis of the mandrel.

The bridging frame (first mandrel supporting portion) between the lower frames 124 rotatably supports a lower end (one end) of the mandrel 21 in place around a horizontal axis (that is, an axis vertical to the sheet plane of FIG. 11A) in a position which intersects the axis of rotation of the mandrel 21 and is twisted with respect to the axis of rotation of main roll 11. Further, the bridging frame (second mandrel supporting portion) between the upper frames 123 rotatably supports an upper end (other end) of the mandrel 21 around the horizontal axis (that is, an axis vertical to the sheet plane of FIG. 11A) in a position which intersects the axis of rotation of the mandrel 21 and is twisted with respect to the axis of rotation of the main roll 11.

Figure 14:
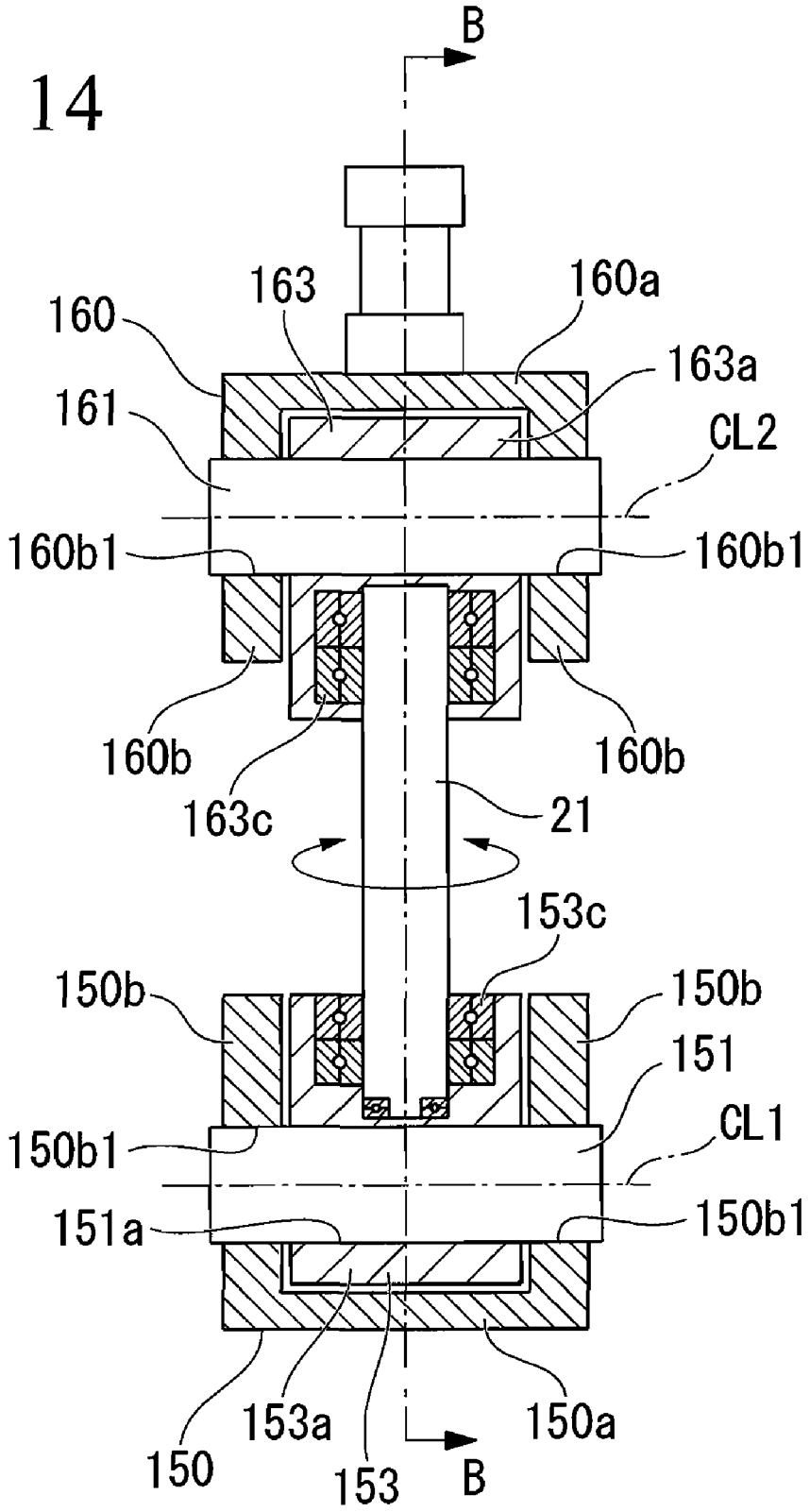
FIG. 14 is a sectional view for explaining a supporting mechanism of the mandrel in the ring rolling mill.

The supporting structure of the mandrel 21 will be described in detail, referring to FIGS. 14 and 15.

The bridging frame between the lower frames 124 is provided with a fixed portion 150 which is integrally attached to this bridging frame, a horizontal shaft 151 fixed to the fixed portion 150, and a rotary portion 153 which is attached to the horizontal shaft 151 so as to be rotatable about a horizontal axis CL1.

The fixed portion 150 includes a bottom wall 150*a*, and a pair of side walls 150*b* formed vertically upward from both ends of the bottom wall 150*a*. A through hole 150*b*1 for allowing the horizontal shaft 151 to be inserted therethrough is formed along the horizontal direction in each side wall 150*b*. Further, as shown in FIG. 15, the upper surface of the bottom wall 150*a* defines a circular-arc surface 150*a*1 as seen in a cross-section vertical to the horizontal axis CL1.

The rotary portion 153 is arranged between the side walls 150*b*, and includes a rotary portion main body 153*a* in which a through hole 151*a* through which the horizontal shaft 151 is inserted along the horizontal direction, and a thrust bearing 153*b* and an axial bearing 153*c* which are provided inside an opening formed at an upper end of the rotary portion main body 153*a*. The thrust bearing 153*b* supports the thrust load by the mandrel 21, and the axial bearing 153*c* supports the bending load which acts on the mandrel 21. A lower end of the mandrel 21 is rotatably supported about the axis of the mandrel by the thrust bearing 153*b* and the axial bearing 153*c*.

Figure 15:
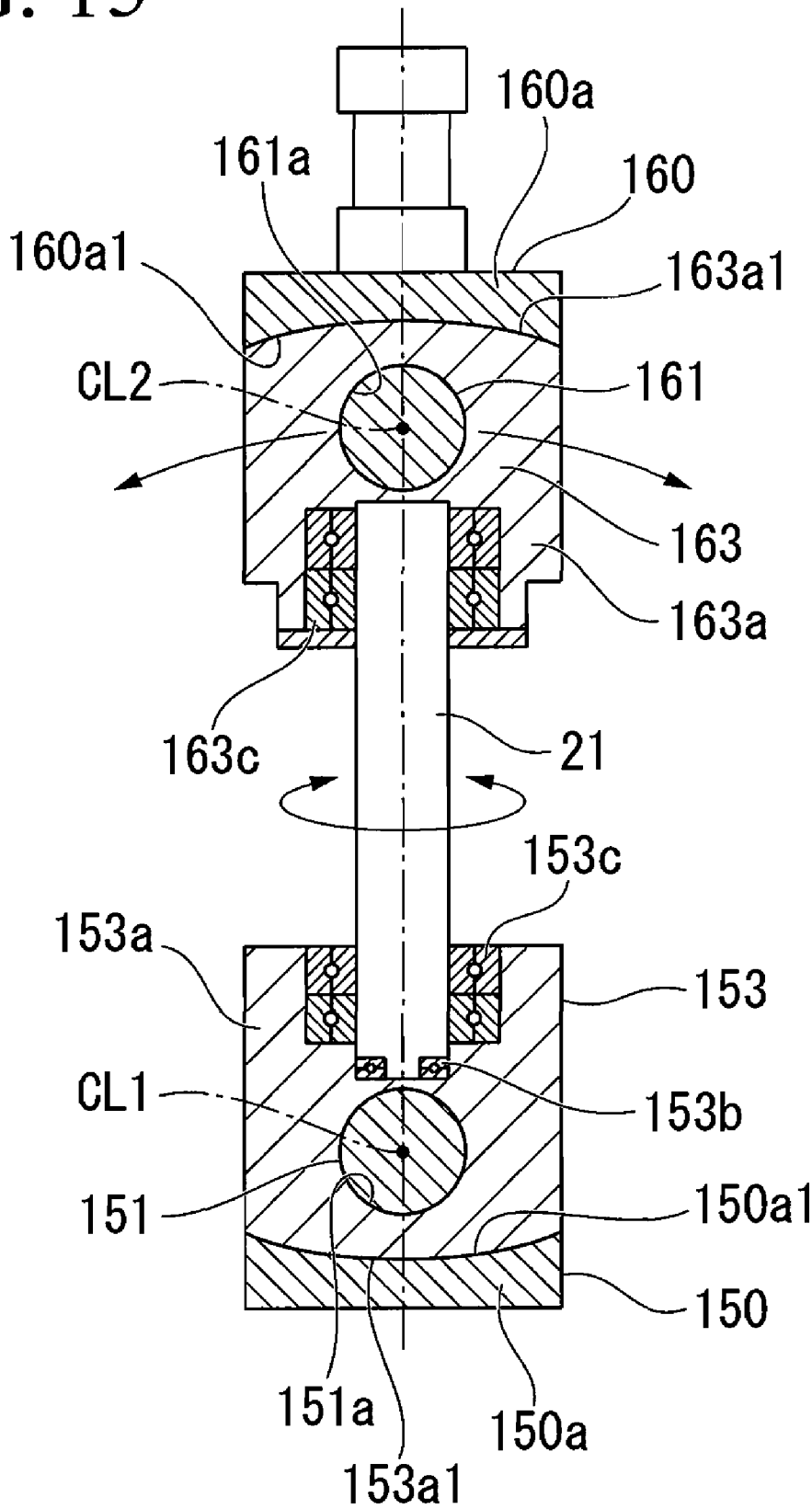
FIG. 15 is a B-B sectional view of FIG. 14 showing the supporting mechanism.

As shown in FIG. 15, as seen in the cross-section vertical to the horizontal axis CL1, a lower surface of the rotary portion main body 153*a* defines a circular-arc surface 153*a*1 which forms a fixed gap with respect to the circular-arc surface 150*a*1, and interferes with the fixed portion 150 during the rotation of the rotary portion main body 153*a*. Accordingly, the thrust load and bending load of the mandrel 21 are transmitted to the thrust bearing 153*b* and axial bearing 153*c*, the rotary portion main body 153*a*, the horizontal shaft 151, each side wall 150*b*, and the bridging frame between the lower frames 124.

Further, the bridging frame between the upper frames 123 is provided with a fixed portion 160 which is integrally attached to this bridging frame, a horizontal shaft 161 fixed to the fixed portion 160, and a rotary portion 163 which is attached to the horizontal shaft 161 so as to be rotatable about a horizontal axis CL2.

The fixed portion 160 includes a top wall 160*a*, and a pair of side walls 160*b* formed vertically downward from both ends of the top wall 160*a*. A through hole 160*b*1 for allowing the horizontal shaft 161 to be inserted therethrough is formed along the horizontal direction in each side wall 160*b*. Further, as shown in FIG. 15, the lower surface of the top wall 160*a* defines a circular-arc surface 160*a*1 as seen in a cross-section vertical to the horizontal axis CL.

The rotary portion 163 is arranged between the side walls 160*b*, and includes a rotary portion main body 163*a* in which a through hole 161*a* through which the horizontal shaft 161 is inserted along the horizontal direction, and a thrust bearing 163*c* which is provided inside an opening formed at a lower end of the rotary portion main body 163*a*. The axial bearing 163*c* supports the bending load which acts on the mandrel 21. An upper end of the mandrel 21 is rotatably supported about the axis of the mandrel by the axial bearing 163*c*.

As shown in FIG. 15, as seen in the cross-section vertical to the horizontal axis CL2, an upper surface of the rotary portion main body 163*a* defines a circular-arc surface 163*a*1 which forms a fixed gap with respect to the circular-arc surface 160*a*1, and interferes with the fixed portion 160 during the rotation of the rotary portion main body 163*a*. Accordingly, the bending load of the mandrel 21 is transmitted to the axial bearing 163*c*, the rotary portion main body 163*a*, the horizontal shaft 161, each side wall 160*b*, and the bridging frame between the lower frames 123.

Also, the fixed portion 150 which supports the lower end of the mandrel 21 is fixed in place along with the bridging frame arranged between the lower frames 124, while the fixed portion 160 which supports the upper end of the mandrel 21 moves in the horizontal direction along with the bridging frame arranged between the upper frames 123. Thus, as shown by arrows of FIG. 15, the mandrel 21 can be rocked so as to be brought close to or separated from the main roll 11 while the mandrel is kept rotatable around its axis of rotation.

Figure 11B:
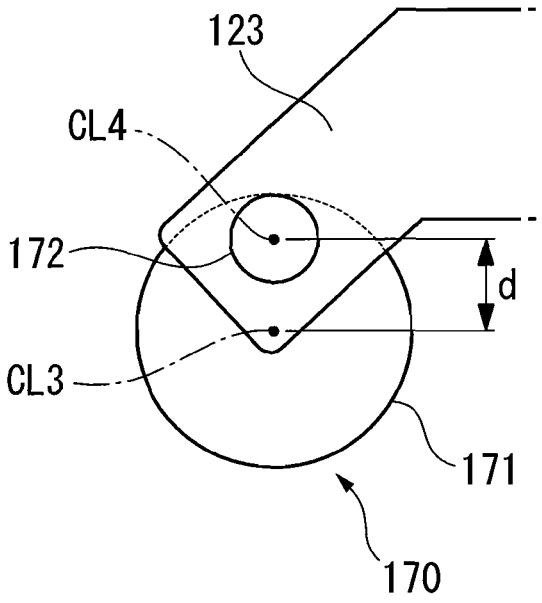
FIG. 11B is a sectional view of an A portion of FIG. 11A.

As shown in FIGS. 11A and 11B, the ring rolling mill 110 of this embodiment is equipped with a driving section 170 (first mandrel driving section) which brings or separates the bridging frame (second mandrel supporting portion) between the upper frames 123 close to or from the main roll 11.

This driving section 170 includes an eccentric shaft 171 which is laid between the intermediate frames 125 in place on each lower frame 124 and has a horizontal axis CL3 extending parallel to the horizontal axes CL1 and CL2; the upper frame 123 (first connecting frame) which connects the eccentric shaft 171, and the bridging frame between the upper frames 123; and a rotation driving portion (not shown) which rotates the eccentric shaft 171 around the horizontal axis CL3.

Pins 172 which are parallel to the horizontal axis CL3 and are provided in positions which are made eccentric by eccentricity d are respectively provided at both ends of the eccentric shaft 171.

A ring rolling method using the ring rolling mill 110 of this embodiment having the configuration described above will be described below.

First, in a case where rolling is performed with a stronger pressing force at the lower end of the peripheral portion of the ring-shaped body W than at the upper end thereof, the rotation driving portion is started to rotate the eccentric shaft 171 in one direction. Then, as shown in FIG. 12, each upper frame 123 slides to the right in the figure. Therefore, the bridging frame laid between the upper frames 123 also moves to the right in the figure. As a result, the upper end of the mandrel 21 also moves to the right in the figure. By stopping the rotation driving portion in a state where the mandrel 21 is inclined at a desired angle in this way, as shown in FIG. 12, the mandrel 21 can be inclined and supported with respect to the axis of rotation of the main roll 11 such that the gap between the outer peripheral surface of the mandrel 21 and the outer peripheral surface of the main roll 11 becomes narrower on the lower side (the other side) than on the upper side (one side) as seen in a direction along the axis of rotation of the main roll 11.

Further in a case where rolling is performed with a stronger pressing force at the upper end of the peripheral portion of the ring-shaped body W than at the lower end thereof, the rotation driving portion is started to rotate the eccentric shaft 171 in the reverse direction. Then, as shown in FIG. 13, each upper frame 123 slides to the left in the figure. Therefore, the bridging frame laid between the upper frames 123 also moves to the left in the figure. As a result, the upper end of the mandrel 21 also moves to the left in the figure. By stopping the rotation driving portion in a state where the mandrel 21 is inclined at a desired angle in this way, as shown in FIG. 13, the mandrel 21 can be inclined and supported with respect to the axis of rotation of the main roll 11 such that the gap between the outer peripheral surface of the mandrel 21 and the outer peripheral surface of the main roll 11 becomes narrower on the upper side (the other side) than on the lower side (one side) as seen in a direction along the axis of rotation of the main roll 11.

In addition, the operation in which the mandrel 21 is brought close to or separated from the main roll 11 in a state where the inclining of the mandrel 21 is fixed can be performed by driving to advance/retreat the advance/retreat driving cylinder 27, and horizontally moving the whole tilting frame 122 to the right and left in the figure.

As described above, according to the ring rolling mill 110 of this embodiment, the same operational effects as those of the ring rolling mill 10 of the above first embodiment can be obtained. That is, according to the ring rolling mill 110 of this embodiment, the pressing forces applied on the peripheral portion of the ring-shaped body W by the main roll 11 and the mandrel 21 can be made different not only along every peripheral position of the peripheral portion, but along positions in the thickness direction.

Figure 17:
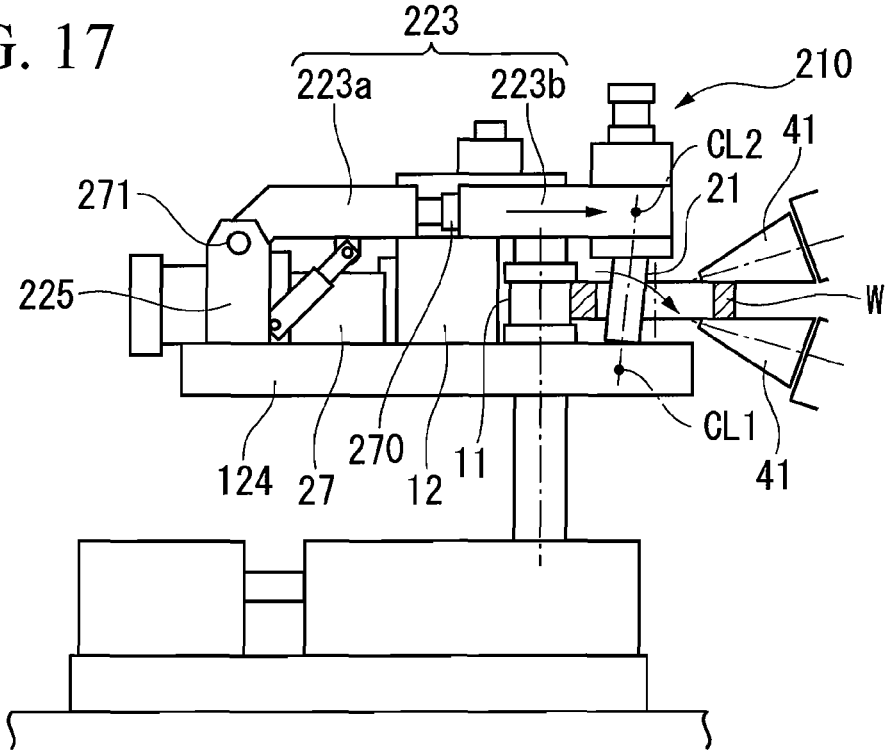
FIG. 17 is a side view for explaining the operation of the ring rolling mill.
Figure 18:
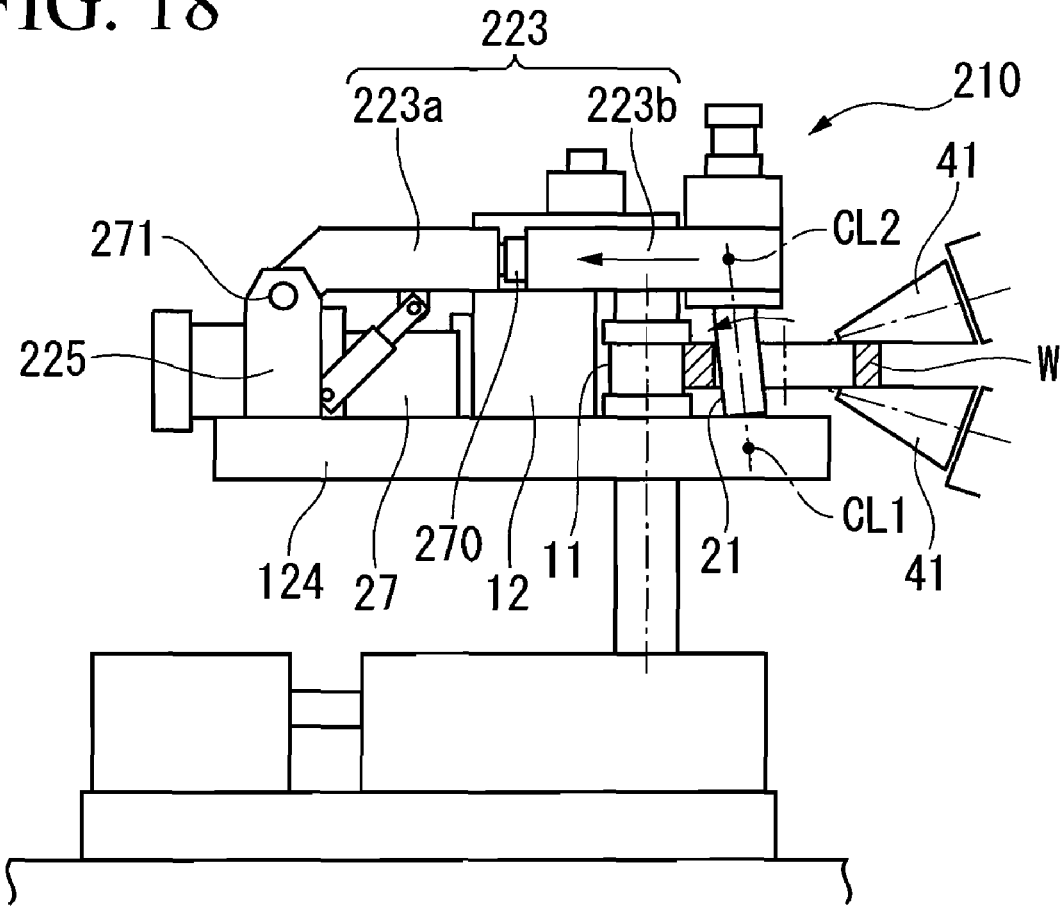
FIG. 18 is a side view for explaining the operation of the ring rolling mill.

Subsequently, a further embodiment of the invention will be described below, referring to FIGS. 16 to 18. In addition, in the following description, differences from those of the above embodiments will be mainly described, but as the other points are the same as those of the above embodiments, the description thereof will be omitted.

In the above embodiment, each upper frame 123 is made to slide by the rotation of the eccentric shaft 171, whereas in the ring rolling mill 210 of this embodiment, the mandrel 21 is tilted by horizontally expanding and retracting a member (hereinafter, upper frame 223) equivalent to the upper frame 123. This embodiment is particularly different from the above embodiment in regard to this point.

Figure 16:
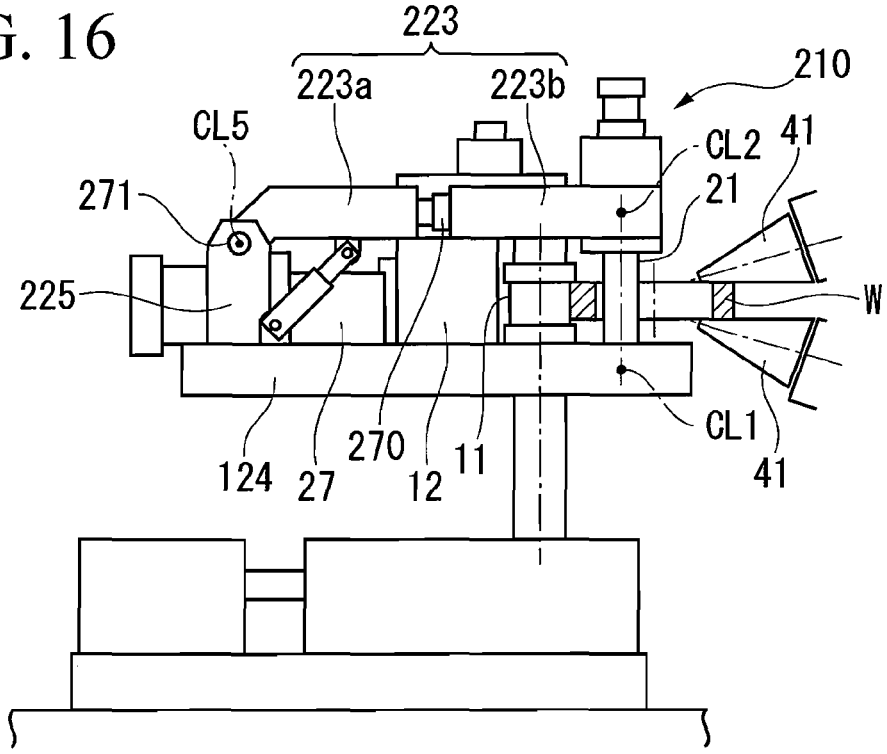
FIG. 16 is a side view showing a further embodiment of the ring rolling mill of the present invention.

As shown in FIG. 16, the ring rolling mill 210 of this embodiment includes a pair of intermediate frames 225 which form base portions fixed in place on the lower frames 124, respectively; a shaft body 271 which is laid between the intermediate frames 225, and has a horizontal axis CL5 parallel to the horizontal axes CL1 and CL2; a pair of upper frames 223 which are rotatably connected to the shaft body 271, and extend horizontally toward the main roll 11 from the mandrel 21.

Each upper frame 223 includes a fixed-side frame 223*a* which is rotatably attached to the shaft body 271; a sliding-side frame 223*b* which is attached to a tip of the fixed-side frame 223*a* so as to be movable in the horizontal direction; and a sliding driving portion 270 which brings or separates the sliding-side frame 223*b* close to or from the fixed-side frame 223*a* along the horizontal direction.

Between front ends of the sliding-side frames 223*b*, a bridging frame (not shown) which connects the front ends is disposed. The front end of the mandrel 21 in the direction of its axis of rotation is supported by this bridging frame so as to be rotatable around the vertical axis of the mandrel. In addition, in this embodiment, each fixed-side frame 223*a* constitutes the base portion of the invention, and the sliding frame 223*b* constitutes a second connecting frame of the invention.

A ring rolling method using the ring rolling mill 210 of this embodiment having the configuration described above will be described below.

First, in a case where rolling is performed with a stronger pressing force at the lower end of the peripheral portion of the ring-shaped body W than at the upper end thereof, each sliding-side frame 223*b* is made to slide to the right in the figure by extending the sliding driving portion 270. Then, the bridging frame laid between the sliding-side frames 223*b* also moves to the right in the figure. As a result, the upper end of the mandrel 21 also moves to the right in the figure. By stopping the sliding driving portion 270 in a state where the mandrel 21 is inclined at a desired angle in this way, as shown in FIG. 17, the mandrel 21 can be inclined and supported with respect to the axis of rotation of the main roll 11 such that the gap between the outer peripheral surface of the mandrel 21 and the outer peripheral surface of the main roll 11 becomes narrower on the lower side (the other side) than on the upper side (one side) as seen in a direction along the axis of rotation of the main roll 11.

Further, in a case where rolling is performed with a stronger pressing force at the upper end of the peripheral portion of the ring-shaped body W than at the lower end thereof, each sliding-side frame 223*b* is made to slide to the left in the figure by retracting the sliding driving portion 270. Then, the bridging frame laid between the sliding-side frames 223*b* also moves to the left in the figure. As a result, the upper end of the mandrel 21 also moves to the left in the figure. By stopping the sliding driving portion 270 in a state where the mandrel 21 is inclined at a desired angle in this way, as shown in FIG. 18, the mandrel 21 can be inclined and supported with respect to the axis of rotation of the main roll 11 such that the gap between the outer peripheral surface of the mandrel 21 and the outer peripheral surface of the main roll 11 becomes narrower on the upper side (the other side) than on the lower side (one side) as seen in a direction along the axis of rotation of the main roll 11.

In addition, the operation in which the mandrel 21 is brought close to or separated from the main roll 11 in a state where the inclining of the mandrel 21 is fixed can be performed by driving to advance/retreat the advance/retreat driving cylinder 27, and horizontally moving the whole tilting frame 122 to the right and left in the figure.

As described above, according to the ring rolling mill 210 of this embodiment, the same operational effects as those of the ring rolling mill 110 of the above embodiment can be obtained. That is, according to the ring rolling mill 210 of this embodiment, the pressing forces applied on the peripheral portion of the ring-shaped body W by the main roll 11 and the mandrel 21 can be made different not only along every peripheral position of the peripheral portion, but also along positions in the thickness direction.

Figure 20:
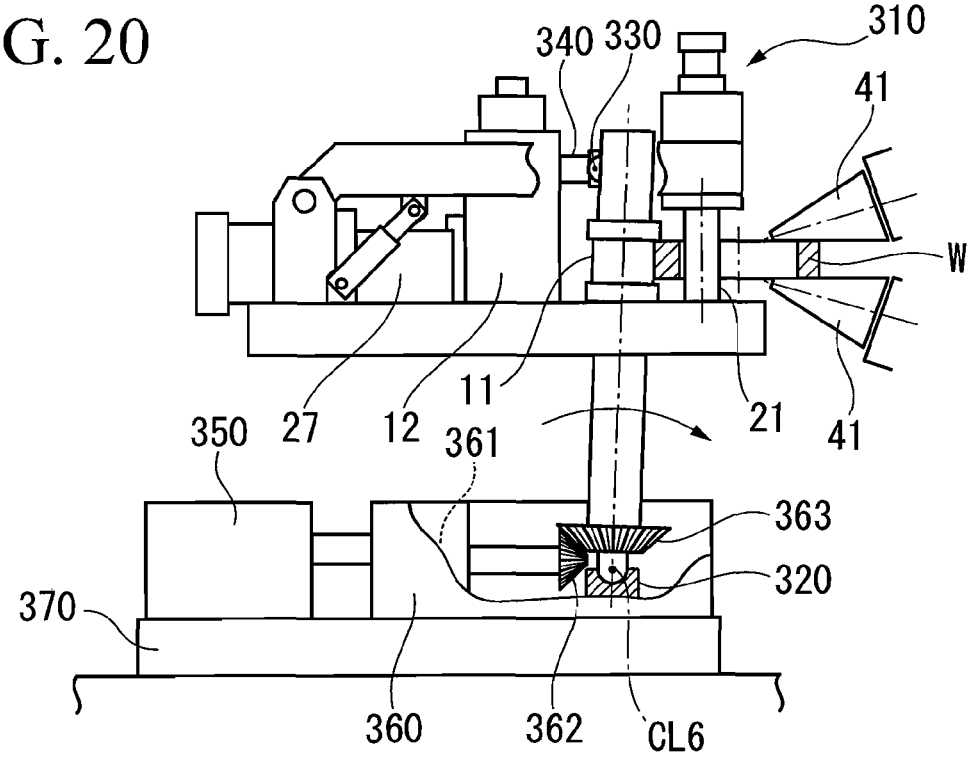
FIG. 20 is a side view for explaining the operation of the ring rolling mill.
Figure 21:
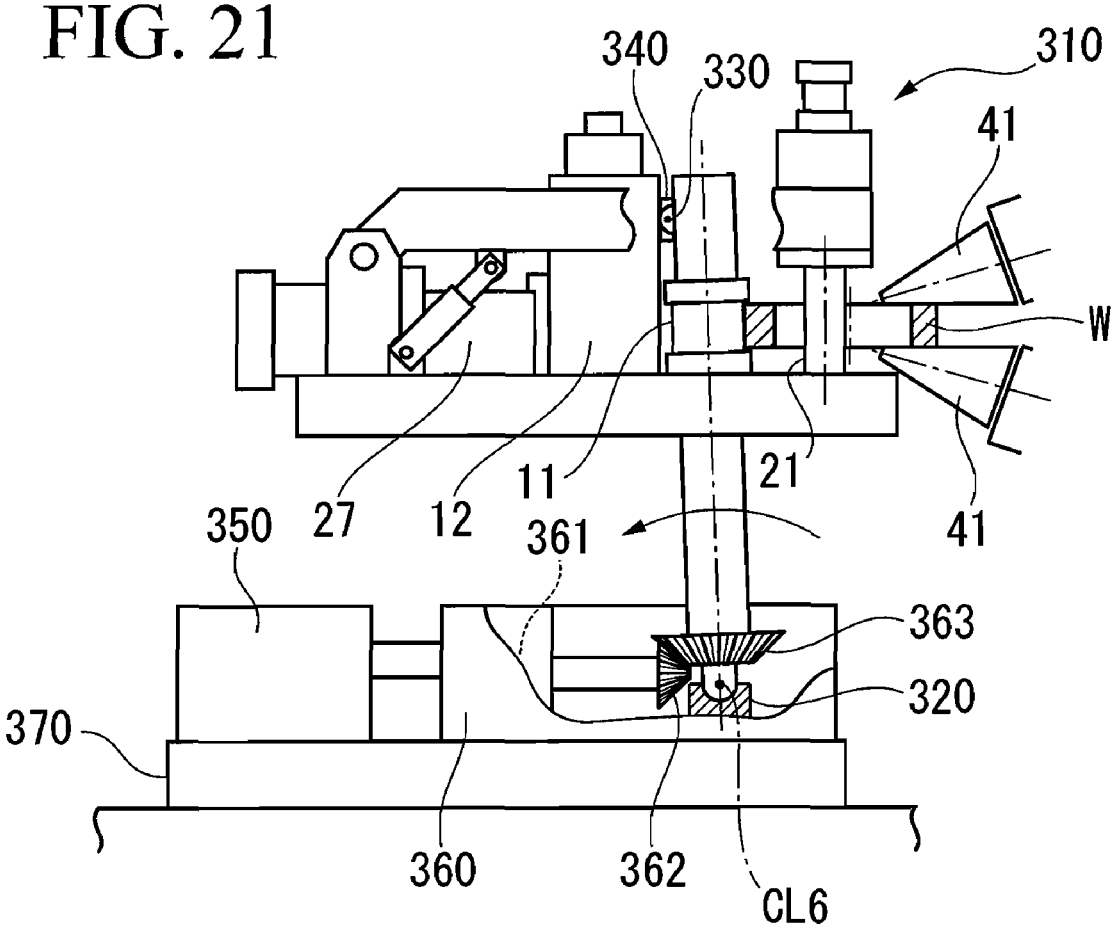
FIG. 21 is a side view for explaining the operation of the ring rolling mill.

Subsequently, an embodiment of the invention will be described below, referring to FIGS. 19 to 21. In addition, in the following description, differences from those of the above embodiments will be mainly described, but as the other points are the same as those of the above embodiments, the description thereof is omitted.

In the above embodiments, a portion on the side of the mandrel 21 is rocked, whereas in a ring rolling mill 310 of this embodiment, a portion on the side of the main roll 11 is rocked. This embodiment is particularly different from the above embodiments in regard to this point.

Figure 19:
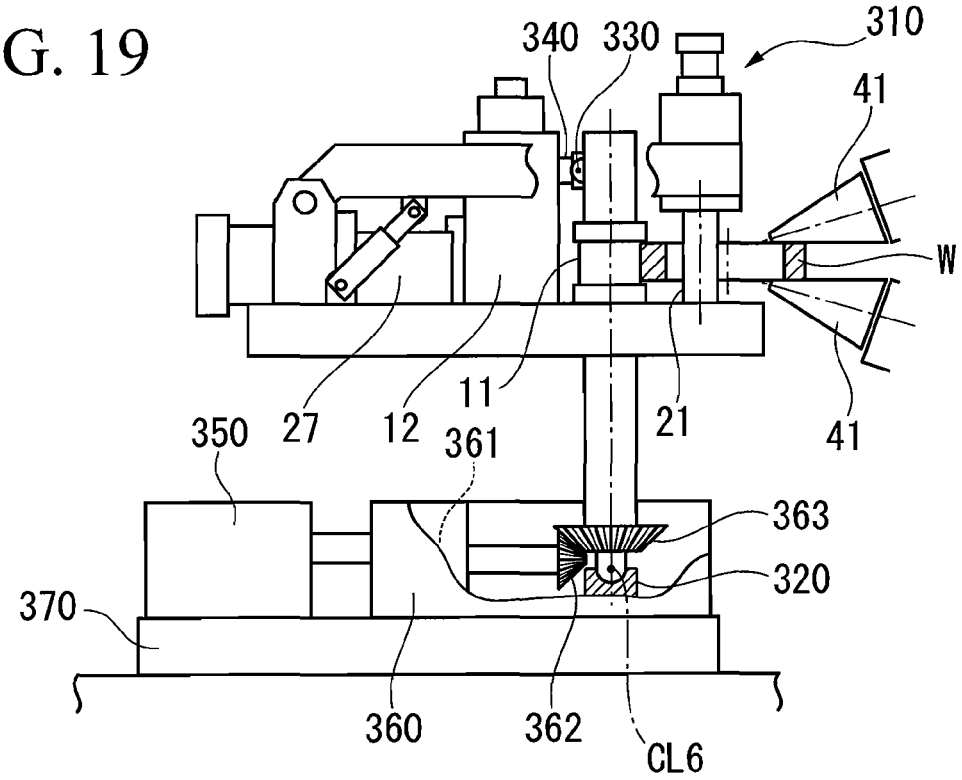
FIG. 19 is a side view showing an embodiment of the ring rolling mill of the present invention.

As shown in FIG. 19, the ring rolling mill 310 of this embodiment includes a main roll inclining/supporting mechanism which inclines and supports the main roll 11 with respect to the axis of rotation of the mandrel 21 such that the gap between the outer peripheral surface of the mandrel 21 and the outer peripheral surface of the main roll 11 differs on vertical upper side (one side) and on vertical lower side (other side) as seen in a direction along the axis of rotation of the mandrel 21.

This main roll inclining/supporting mechanism includes a spherical bearing 320 (first main roll supporting portion) which rotatably supports the lower end (one end) of the main roll 11 in place, an upper bearing 330 (second main roll supporting portion) which rotatably supports the upper end (other end) of the main roll 11, and a main roll driving portion 340 (first main roll driving portion) which brings or separates the upper bearing 330 close to or from the mandrel 21.

Further, the ring rolling mill 310 of this embodiment further includes a main roll driving source 350 which generates a driving force which rotates the main roll 11, a transmission section 360 which transmits a rotational driving force from the main roll driving source 350 to the main roll 11, and a pedestal 370 on which the main roll driving source 350 and the transmission section 360 are installed. The transmission section 360 is provided with a gear mechanism 361 for transmitting a rotational driving force from the main roll driving source 350, and the spherical bearing 320 which supports the lower end of the main roll 11 so that the main roll 11 can be rocked in a direction in which it is brought close to or separated from the mandrel 21. The gear mechanism 361 and the lower end of the main roll 11 are connected together via bevel gears 362 and 363, and the rotational driving force from the main roll driving source 350 is transmitted to the gear mechanism 361, the bevel gears 362 and 363, and the main roll 11. Even if the main roll 11 rocks during transmission of this rotational driving force, a bending joint (not shown) is provided in the gear mechanism 361 so that the engagement between the bevel gears 362 and 363 may be maintained suitably.

The main roll driving portion 340 is a hydraulic cylinder provided between the fixed frame 12 and the upper bearing 330, and brings or separates the main roll 11 close to or from the fixed frame 12 as the driving portion itself performs extension/retraction operation. As mentioned above, since the lower end of the main roll 11 is rockably supported on the spherical bearing 320, the main roll 11 can be tilted around a horizontal axis CL6 vertical to the sheet plane so that it can be brought close to or separated from the mandrel 21 fixed in place by driving the main roll driving portion 340. The horizontal axis CL6 is in a position which intersects the axis of the main roll 11, and is twisted with respect to the axis of the mandrel 21.

A ring rolling method using the ring rolling mill 310 of this embodiment having the configuration described above will be described below.

First, in a case where rolling is performed with a stronger pressing force at the upper end of the peripheral portion of the ring-shaped body W than at the lower end thereof, the main roll 11 is tilted to the right in the figure about the horizontal axis CL6 by driving the main roll driving portion 340 to extend it. By stopping the main roll driving portion 340 in a state where the main roll 11 is inclined at a desired angle in this way, as shown in FIG. 20, the mandrel 21 can be inclined and supported with respect to the axis of rotation of the main roll 11 such that the gap between the outer peripheral surface of the mandrel 21 and the outer peripheral surface of the main roll 11 becomes narrower on the upper side (the other side) than on the lower side (one side) as seen in a direction along the axis of rotation of the main roll 11.

Further, in a case where rolling is performed with a stronger pressing force at the lower end of the peripheral portion of the ring-shaped body W than at the upper end thereof, the main roll 11 is tilted to the left in the figure about the horizontal axis CL6 by driving the main roll driving portion 340 to retract it. By stopping the main roll driving portion 340 in a state where the main roll 11 is inclined at a desired angle in this way, as shown in FIG. 21, the mandrel 21 can be inclined and supported with respect to the axis of rotation of the main roll 11 such that the gap between the outer peripheral surface of the mandrel 21 and the outer peripheral surface of the main roll 11 becomes narrower on the lower side (the other side) than on the upper side (one side) as seen in a direction along the axis of rotation of the main roll 11.

In addition, the operation in which the mandrel 21 is brought close to or separated from the main roll 11 in a state where the inclining of the main roll 11 is fixed can be performed by driving to advance/retreat the advance/retreat driving cylinder 27, and horizontally moving the whole supporting structure of the mandrel 21 to the right and left in the figure.

As described above, according to the ring rolling mill 310 of this embodiment, the same operational effects as those of the ring rolling mill 110 of the above second embodiment can be obtained. That is, according to the ring rolling mill 310 of this embodiment, the pressing forces applied on the peripheral portion of the ring-shaped body W by the main roll 11 and the mandrel 21 can be made different not only along every peripheral position of the peripheral portion, but also along every position in the thickness direction.

Figure 23:
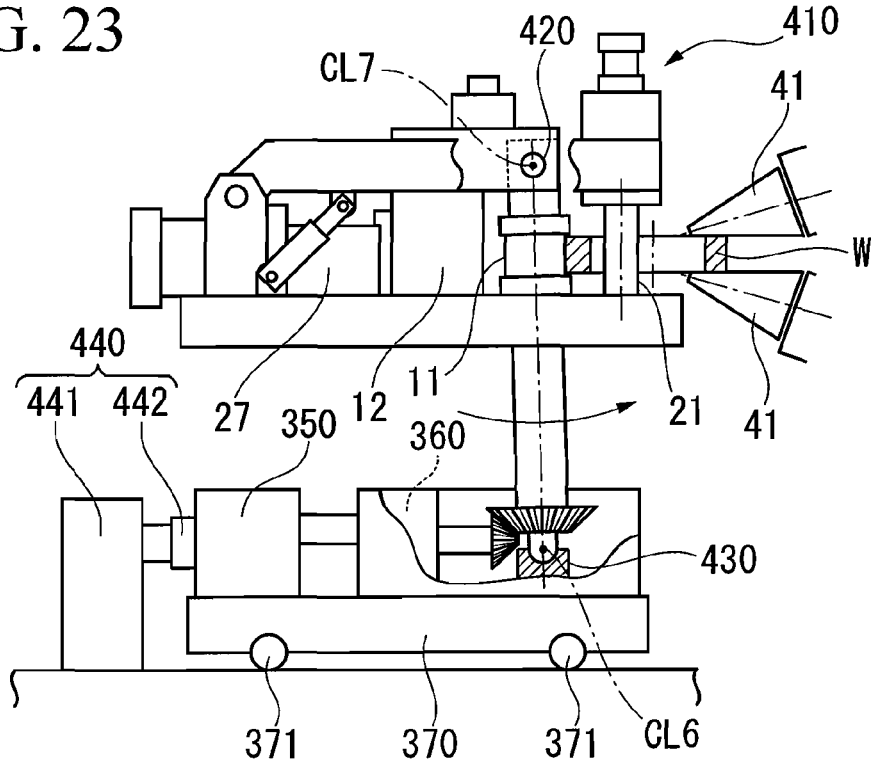
FIG. 23 is a side view for explaining the operation of the ring rolling mill.
Figure 24:
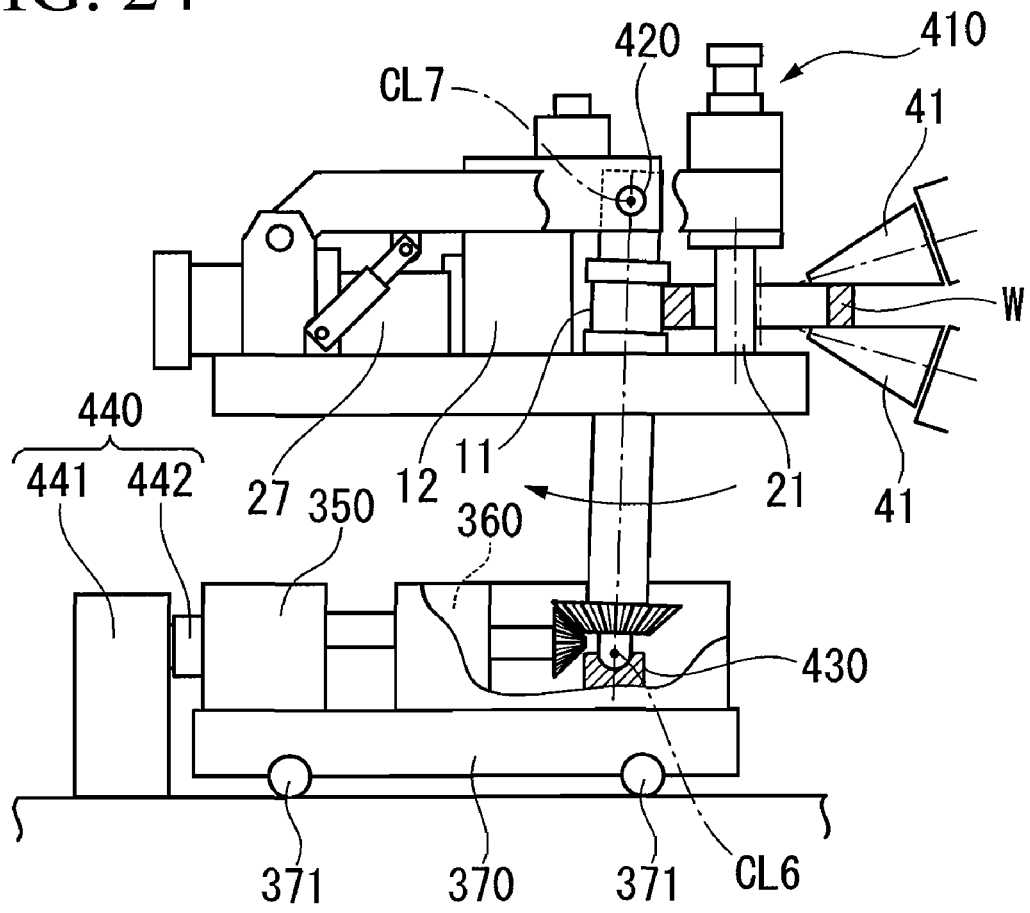
FIG. 24 is a side view for explaining the operation of the ring rolling mill.

Subsequently, another embodiment of the invention will be described below, referring to FIGS. 22 to 24. In addition, in the following description, differences from those of the above embodiments will be mainly described, but as the other points are the same as those of the above embodiments, the description thereof is omitted.

In the above embodiments, a portion on the upper end of the main roll 11 is rocked, whereas in a ring rolling mill 410 of this embodiment, a portion on the lower end of the main roll 11 is rocked. This embodiment is particularly different from the above embodiments in regard to this point.

Figure 22:
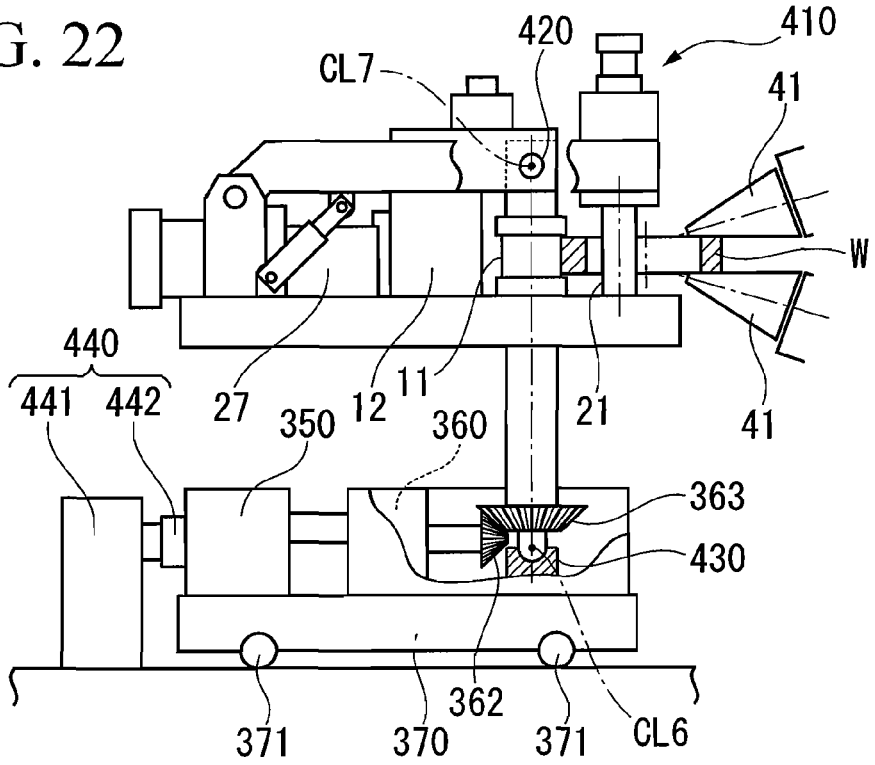
FIG. 22 is a side view showing another embodiment of the ring rolling mill of the invention.

As shown in FIG. 22, the ring rolling mill 410 of this embodiment includes a main roll inclining/supporting mechanism which inclines and supports the main roll 11 with respect to the axis of rotation of the mandrel 21 such that the gap between the outer peripheral surface of the mandrel 21 and the outer peripheral surface of the main roll 11 differs on vertical upper side (one side) and on vertical lower side (other side) as seen in a direction along the axis of rotation of the mandrel 21.

This main roll inclining/supporting mechanism includes a supporting pin 420 (first main roll supporting portion) which rotatably supports the upper end (one end) of the main roll 11 in place, a spherical bearing 430 (second main roll supporting portion) which rotatably supports the lower end (other end) of the main roll 11, and a main roll driving portion 440 (first main roll driving portion) which brings or separates the spherical bearing 430 close to or from the mandrel 21.

The supporting pin 420 supports the upper end of the main roll 11 so that it can be tilted around a horizontal axis CL7 (axis vertical to the sheet plane of FIG. 22) which intersects the axis of the main roll 11 and is twisted with respect to the axis of the mandrel 21.

The pedestal 370 of this embodiment is provided with wheels 371 which support the pedestal 370 so as to be able to run along one direction. Accordingly, the main roll driving source 350 and the transmission section 360 are integrated with the pedestal 370, and move to the right and left in FIG. 22.

The main roll driving portion 440 includes an anchor 441 which is installed in place, and a hydraulic cylinder 442 which is provided between the anchor 441 and the main roll driving source 350. When the hydraulic cylinder 442 performs extension/retraction operation, the main roll driving portion moves the main roll driving source 350, the transmission section 360, and the pedestal 370 to the right and left in FIG. 22. As mentioned above, since the upper end of the main roll 11 is rockably supported by the supporting pin 420, the main roll 11 can be tilted around the horizontal axis CL7 so that it can be brought close to or separated from the mandrel 21 fixed in place by driving the main roll driving portion 440.

A ring rolling method using the ring rolling mill 410 of this embodiment having the configuration described above will be described below.

First, in a case where rolling is performed with a stronger pressing force at the lower end of the peripheral portion of the ring-shaped body W than at the upper end thereof, the main roll 11 is tilted to the right in the figure about the horizontal axis CL7 by driving the main roll driving portion 440 to extend the hydraulic cylinder 442. By stopping the main roll driving portion 440 in a state where the main roll 11 is inclined at a desired angle in this way, as shown in FIG. 23, the mandrel 21 can be inclined and supported with respect to the axis of rotation of the main roll 11 such that the gap between the outer peripheral surface of the mandrel 21 and the outer peripheral surface of the main roll 11 becomes narrower on the lower side (the other side) than on the upper side (one side) as seen in a direction along the axis of rotation of the main roll 11.

Further, in a case where rolling is performed with a stronger pressing force at the upper end of the peripheral portion of the ring-shaped body W than at the lower end thereof, the main roll 11 is tilted to the left in the figure about the horizontal axis CL7 by driving the main roll driving portion 440 to retract the hydraulic cylinder 442. By stopping the main roll driving portion 440 in a state where the main roll 11 is inclined at a desired angle in this way, as shown in FIG. 24, the mandrel 21 can be inclined and supported with respect to the axis of rotation of the main roll 11 such that the gap between the outer peripheral surface of the mandrel 21 and the outer peripheral surface of the main roll 11 becomes narrower on the upper side (the other side) than on the lower side (one side) as seen in a direction along the axis of rotation of the main roll 11.

In addition, the operation in which the mandrel 21 is brought close to or separated from the main roll 11 in a state where the inclining of the main roll 11 is fixed can be performed by driving to advance/retreat the advance/retreat driving cylinder 27, and horizontally moving the whole supporting structure of the mandrel 21 to the right and left in the figure.

As described above, according to the ring rolling mill 410 of this embodiment, the same operational effects as those of the ring rolling mill 310 of the above embodiments can be obtained. That is, according to the ring rolling mill 410 of this embodiment, the pressing forces applied on the peripheral portion of the ring-shaped body W by the main roll 11 and the mandrel 21 can be made different not only along every peripheral position of the peripheral portion, but along every position in the thickness direction.

In addition, various shapes or combinations of respective constituent members illustrated in the embodiments described above are merely examples, and various changes may be made depending on design requirements without departing from the spirit or scope of the present invention.

For example, the configuration in which the axial rolls 41 are supported so that they can be rotationally driven around their axes of rotation is shown in the above first embodiment. Instead of this, however, the axial rolls 41 may be rotatably supported, and may rotate as the ring-shaped body W is rotated in its peripheral direction by the main roll 11 and the mandrel 21.

Further, in the foregoing embodiments, either the mandrel 21 or the main roll 11 is tilted with respect to the other one. However, the invention is not limited thereto. Both the mandrel 21 and the main roll 11 may be tilted.

Further, in certain embodiments, only the upper end supporting portion of the mandrel 21 is rocked. However, the invention is not limited thereto. A drive mechanism (second mandrel driving portion) which independently brings or separates both an upper end supporting portion (third mandrel supporting portion) and a lower end supporting portion (fourth mandrel supporting portion) of the mandrel 21 close to or from the main roll 11 may be utilized.

Further, in certain embodiments, only either an upper end supporting portion or a lower end supporting portion of the main roll 11 is rocked. However, the invention is not limited thereto. A drive mechanism (second main roll driving portion) which independently brings or separates both the upper end supporting portion (first main roll supporting portion) and the lower end supporting portion (second main roll supporting portion) of the main roll 11 close to or from the mandrel 21 may be utilized.

The pressing forces applied on the peripheral portion of the ring-shaped body by the main roll and the mandrel can be made different locally in the peripheral portion of the ring-shaped body.

The invention claimed is:

1. A ring rolling mill comprising:

a main roll that is rotated around its center axis and is supported by a fixed frame;

a mandrel that is rotated around its center axis; and a mandrel inclining and supporting mechanism that comprises at least one supporting frame, at least one pin, and a driving section;

wherein the supporting frame extends from the mandrel toward the main roll and supports upper and lower ends of the mandrel, the pin is inserted through the supporting frame in a direction perpendicular to the center axis of the mandrel such that the supporting frame becomes rotatable about the pin, the driving section inclines the supporting frame about the pin and brings the main roll and mandrel close to or away from each other, the ring rolling mill rolls a peripheral portion of a ring-shaped body in a radial direction of the ring-shaped body while the ring-shaped body is rotated along its peripheral direction in a state where the peripheral portion of the ring-shaped body is pinched in the radial direction between an outer peripheral surface of the main roll which is rotationally driven and an outer peripheral surface of the mandrel which is rotatable, and during rolling of the ring-shaped body the mandrel inclining and supporting mechanism is arranged so as to incline and support the mandrel with respect to the center axis of the main roll such that a gap between the outer peripheral surface of the mandrel and the outer peripheral surface of the main roll differs between an upper and lower portion of the gap in a direction along the center axis of the main roll.

2. A ring rolling mill comprising:

a main roll that is rotated around its center axis and is supported by a fixed frame;

a mandrel that is rotated around its center axis; and a mandrel inclining and supporting mechanism that comprises;

a first mandrel supporting portion which rotatably supports one end of the mandrel, a second mandrel supporting portion which rotatably supports the other end of the mandrel, a first mandrel driving section connected to the second mandrel supporting portion and acts to bring the second mandrel supporting portion close to or away from the main roll, a shaft having a center axis that is fixed to each of the first mandrel supporting portion and second mandrel supporting portion, the shaft being in a position perpendicularly intersecting the center axis of the mandrel and being in a position twisted with respect to the center axis of the main roll, and a rotary portion which is attached to the first mandrel supporting portion and second mandrel supporting portion so as to be rotatable about the center axis of the shaft, wherein the first mandrel driving section moves the second mandrel supporting portion relatively in a direction perpendicular to both the center axis of the mandrel and the center axis of the shaft, wherein the main roll and mandrel are brought close to or away from each other, the ring rolling mill rolls a peripheral portion of a ring-shaped body in a radial direction of the ring-shaped body while the ring-shaped body is rotated along its peripheral direction in a state where the peripheral portion of the ring-shaped body is pinched in the radial direction between an outer peripheral surface of the main roll which is rotationally driven and an outer peripheral surface of the mandrel which is rotatable, and during rolling of the ring-shaped body, the mandrel inclining and supporting mechanism is arranged so as to incline and support the mandrel with respect to the center axis of the main roll such that a gap between the outer peripheral surface of the mandrel and the outer peripheral surface of the main roll differs between an upper and lower portion of the gap in a direction along the center axis of the main roll.

3. The ring rolling mill according to claim 2, wherein the first mandrel driving section comprises:

an eccentric shaft fixed in place;

a first connecting frame which connects the eccentric shaft and the first mandrel supporting portion; and a rotation driving portion which rotates the eccentric shaft.

4. The ring rolling mill according to claim 2, wherein the first mandrel driving section comprises:

a base portion fixed in place;

a second connecting frame which connects the base portion and the first mandrel supporting portion; and a sliding driving portion which moves the second connecting frame relative to the base portion.

5. A ring rolling mill comprising:

a main roll that is rotated around its center axis and is supported by a fixed frame;

a mandrel that is rotated around its center axis; and a mandrel inclining and supporting mechanism that comprises;

a third mandrel supporting portion which rotatably supports one end of the mandrel, a fourth mandrel supporting portion which rotatably supports the other end of the mandrel, a second mandrel driving portion which independently brings both the third mandrel supporting portion and the fourth mandrel supporting portion close to or away from the main roll, a shaft having a center axis that is fixed to each of the third mandrel supporting portion and fourth mandrel supporting portion, the shaft being in a position perpendicularly intersecting the center axis of the mandrel and being in a position twisted with respect to the center axis of the main roll, and a rotary portion which is attached to the first mandrel supporting portion and second mandrel supporting portion so as to be rotatable about the center axis of the shaft, wherein the second mandrel driving section moves the third mandrel supporting portion and the fourth mandrel supporting portion relatively in a direction perpendicular to both the center axis of the mandrel and the center axis of the shaft, wherein the main roll and mandrel are brought close to or away from each other, the ring rolling mill rolls a peripheral portion of a ring-shaped body in a radial direction of the ring-shaped body while the ring-shaped body is rotated along its peripheral direction in a state where the peripheral portion of the ring-shaped body is pinched in the radial direction between an outer peripheral surface of the main roll which is rotationally driven and an outer peripheral surface of the mandrel which is rotatable, and during rolling of the ring-shaped body, the mandrel inclining and supporting mechanism is arranged so as to incline and support the mandrel with respect to the center axis of the main roll such that a gap between the outer peripheral surface of the mandrel and the outer peripheral surface of the main roll differs between an upper and lower portion of the gap in a direction along the center axis of the main roll.

6. A ring rolling method of rolling a peripheral portion of a ring-shaped body in its radial direction while the ring-shaped body is rotated along its peripheral direction in a state where the peripheral portion of the ring-shaped body is pinched between a main roll and a mandrel provided so as to be capable of being brought close to or away from each other, comprising the steps of:

providing a ring rolling mill according to claim 1; and inclining and supporting the mandrel during rolling of the ring-shaped body with respect to the center axis of the main roll such that a gap between an outer peripheral surface of the mandrel and an outer peripheral surface of the main roll differs between the upper and lower portion of the gap in a direction along the center axis of the main roll while the supporting frame inclines along the pin.

7. The ring rolling method according to claim 6, further comprising the steps of:

rolling the peripheral portion of the ring-shaped body while inclining the mandrel such that the gap becomes smaller on the upper portion than on the lower portion; and rolling the peripheral portion of the ring-shaped body while inclining the mandrel such that the gap becomes smaller on the lower portion than on the upper portion.

8. A ring rolling method of rolling a peripheral portion of a ring-shaped body in its radial direction while the ring-shaped body is rotated along its peripheral direction in a state where the peripheral portion of the ring-shaped body is pinched between a main roll and a mandrel provided so as to be capable of being brought close to or away from each other, comprising the steps of:

providing a ring rolling mill according to claim 2; and inclining and supporting the mandrel during rolling of the ring-shaped body with respect to the center axis of the main roll such that a gap between an outer peripheral surface of the mandrel and an outer peripheral surface of the main roll differs between the upper and lower portion of the gap in a direction along the center axis of the main roll by moving a second mandrel supporting portion relatively in a direction perpendicular to both the center axis of the mandrel and the center axis of the shaft.

9. The ring rolling method according to claim 8, further comprising the steps of:

rolling the peripheral portion of the ring-shaped body while inclining the mandrel such that the gap become smaller on the upper portion than on the lower portion; and rolling the peripheral portion of the ring-shaped body while inclining the mandrel such that the gap becomes smaller on the lower portion than on the upper portion.

10. A ring rolling method of rolling a peripheral portion of a ring-shaped body in its radial direction while the ring-shaped body is rotated along its peripheral direction in a state where the peripheral portion of the ring-shaped body is pinched between a main roll and a mandrel provided so as to be capable of being brought close to or away from each other, comprising the steps of:

providing a ring rolling mill according to claim 5; and inclining and supporting the mandrel during rolling of the ring-shaped body with respect to the center axis of the main roll such that a gap between an outer peripheral surface of the mandrel and an outer peripheral surface of the main roll differs between the upper and lower portion of the gap in a direction along the center axis of the main roll by moving the third mandrel supporting portion and the fourth mandrel supporting portion relatively in a direction perpendicular to both the center axis of the mandrel and the center axis of the shaft.

11. The ring rolling method according to claim 10, further comprising the steps of:

rolling the peripheral portion of the ring-shaped body while inclining the mandrel such that the gap become smaller on the upper portion than on the lower portion; and rolling the peripheral portion of the ring-shaped body while inclining the mandrel such that the gap becomes smaller on the lower portion than on the upper portion.

* * * * *